US006336755B1

(12) United States Patent
Sanada et al.

(10) Patent No.: US 6,336,755 B1
(45) Date of Patent: Jan. 8, 2002

(54) IMAGE FORMING APPARATUS

(75) Inventors: Kazuo Sanada; Tsutomu Takatsuka; Seiichi Inoue, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/504,578

(22) Filed: Feb. 15, 2000

(30) Foreign Application Priority Data

Feb. 16, 1999 (JP) ..... 11-037750
Jun. 21, 1999 (JP) ..... 11-173906
Jan. 18, 2000 (JP) ..... 12-008860

(51) Int. Cl.[7] ..... G03D 5/00
(52) U.S. Cl. ..... 396/604; 396/627
(58) Field of Search ..... 396/604, 605, 396/609, 627; 355/27–29

(56) References Cited

U.S. PATENT DOCUMENTS 4,977,422 A * 12/1990 Vaughn, IV ..... 396/620
5,027,146 A * 6/1991 Manico et al. ..... 396/627
5,960,224 A * 9/1999 Sanada et al. ..... 396/604
6,001,544 A * 12/1999 Makuta et al. ..... 430/405
6,159,668 A * 12/2000 Makuta ..... 430/405

FOREIGN PATENT DOCUMENTS

EP 901041 * 3/1999 ..... 396/FOR 942

* cited by examiner

*Primary Examiner*—D. Rutledge
(74) *Attorney, Agent, or Firm*—Sughrue Mion, PLLC

(57) ABSTRACT

An image forming processing in which a minimum necessary amount of a processing solution, including hydrogen peroxide, which is substantially devoid of developing agents, an alkaline processing solution, and/or a post-processing solution is applied by a processing solution applying mechanism and the like serving as a non-contacting applying mechanism. The solutions are applied only on a surface of a silver halide photographic photosensitive material, which surface is provided with a photographic structuring layer having a single layer containing a reducing agent. Accordingly, neither the processing solution nor the post-processing solution is wasted and the photosensitive material can be speedily dried.

29 Claims, 13 Drawing Sheets

IMAGE FORMING APPARATUS

BACKGROUND OF THE INVENTION

1. Field of the Invention

The present invention relates to an image forming apparatus, which can apply processing solution or post-processing solution appropriately on an image recording material such as a photosensitive material so as to form an image.

2. Description of the Related Art

Conventionally, when a color film or a color printed original is copied to an image recording material, for example, a photosensitive material such as a silver halide photographic photosensitive material, each of processings including exposing, developing, bleach-fixing, rinsing and drying are sequentially performed.

When the developing, bleach-fixing and rinsing are performed, the developing solution, bleaching solution and rinsing water are applied on the photosensitive material by "dipping" the photosensitive material sequentially into each of the developing solution, bleaching solution and rinsing water, which are processing solutions stored in a developing tank, a bleach-fixing tank and a rinsing tank, respectively.

When the dipping method is carried out in this manner, i.e., the processing solution is applied by immersing the photosensitive material into the tank filled with the processing solution, the processing solution is applied on the entire two surfaces of the photosensitive material. Since the processing solution is applied to a reverse surface of the photosensitive material, which surface does not have a photographic structuring layer formed thereon, the processing solution is used wastefully and inefficiently. Accordingly, a large amount of the processing solution is needed. Further, when the image forming apparatus is structured to dip the photosensitive material into the processing solution stored in the tank, spent processing solution, which has been used to process the photosensitive material and in which chemical changes have been thereby caused, is mixed in the processing solution stored in the next processing tank. Further, the area that the processing solution is in contact with the air is large. Thus, primary components of the processing solution deteriorate, hardening of the processing solution is advanced, and the use-life of the processing solution is shortened. As a result, the amount of spent waste solution is correspondingly increased. Accordingly, there is a problem because a large amount of the spent waste solution of the processing solution must be disposed.

SUMMARY OF THE INVENTION

In view of the aforementioned circumstances, execution of each processing by applying a small amount of processing solution or post-processing solution is made possible. Further, it is an object of the present invention to provide an image forming apparatus that can reduce the amount of waste solution to be processed.

A first aspect of the present invention is an image forming apparatus comprising: processing solution applying means for applying alkaline processing solution including hydrogen peroxide, which alkaline processing solution is substantially devoid of developing agents, to substantially only a photographic structuring layer side of an exposed silver halide photographic photosensitive material, the silver halide photographic photosensitive material having a support and at least one photographic structuring layer formed on the support, which photographic structuring layer comprises a dye-forming coupler and a reducing agent.

A second aspect of the present invention is an image forming apparatus comprising: processing solution applying means for applying alkaline processing solution, which is substantially devoid of developing agents, to substantially only a photographic structuring layer side of an exposed silver halide photographic photosensitive material, the silver halide photographic photosensitive material having a support and at least one photographic structuring layer formed on the support, which photographic structuring layer comprises a dye-forming coupler and a reducing agent.

A third aspect of the present invention is an image forming apparatus comprising: processing solution applying means for applying solution including hydrogen peroxide to substantially only a photographic structuring layer side of an exposed silver halide photographic photosensitive material, the silver halide photographic photosensitive material having a support and at least one photographic structuring layer formed on the support, which photographic structuring layer comprises a dye-forming coupler and a reducing agent.

Being structured in the above-described manner, the processing solution applying means performs development-intensification processing by applying the processing solution only on the photographic structuring layer side of the silver halide photographic photo sensitive material.

As a result, a required small amount of the processing solution is applied, and the applied processing solution is used up and disposed of each time. Accordingly, waste solution which has been used many times and has deteriorated is not generated. Thus, disposal of waste solution is not necessary.

Further, as waste solution is not generated as described above, the amount of the processing solution can be reduced correspondingly, with the result that a large amount of the processing solution is not needed. Therefore, this apparatus is easily maintained and can perform stable developing processing.

Further, the entire image forming apparatus can be structured compactly.

DESCRIPTION OF THE PREFERRED EMBODIMENTS

Figure 1:
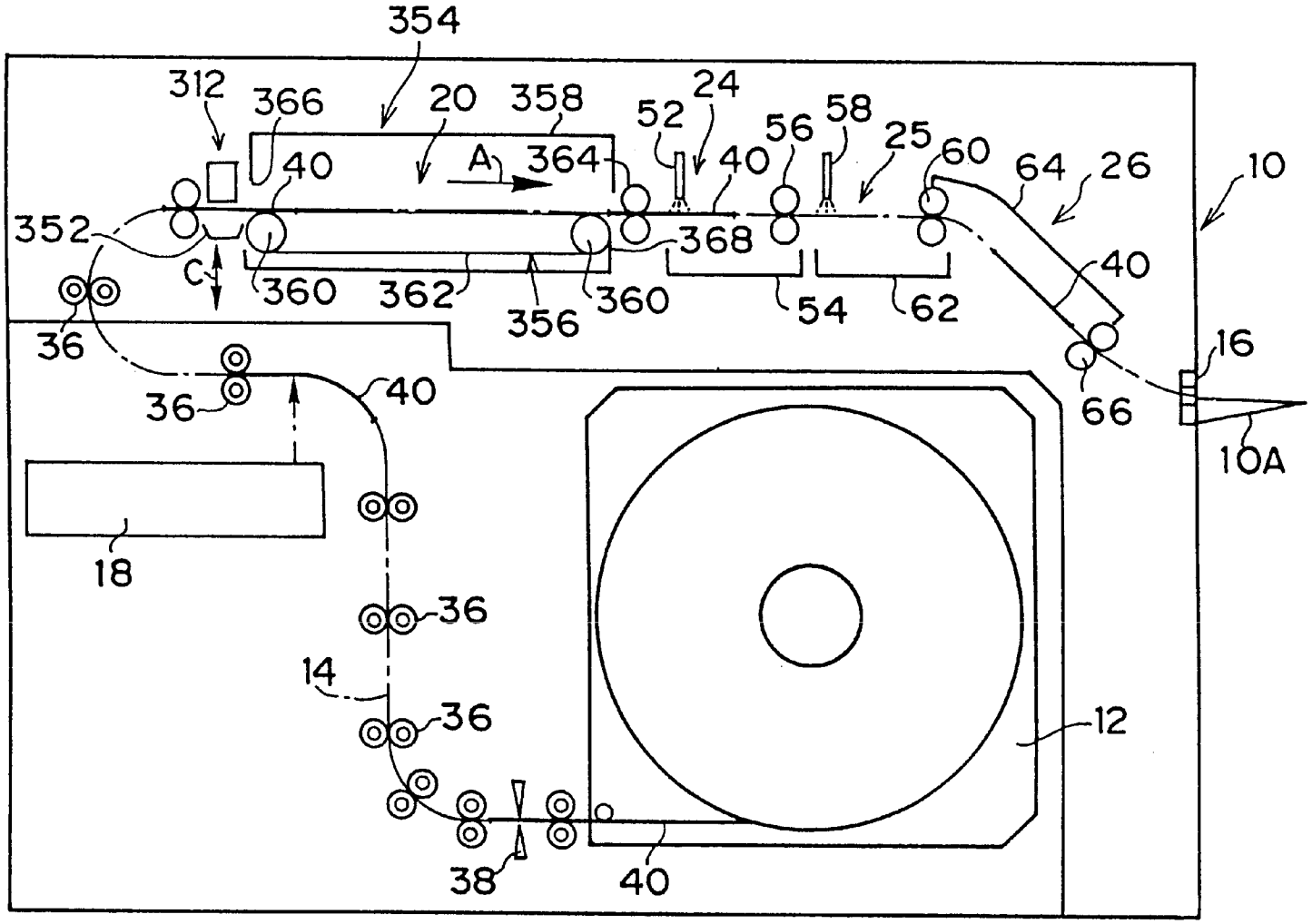
FIG. 1 is a front view showing a schematic structure of an entire image forming apparatus according to a first embodiment of the present invention.

FIG. 1 shows a schematic total structure of an image forming apparatus according to a first embodiment of the present invention, wherein the apparatus includes processing solution applying means.

In the image forming apparatus shown in FIG. 1, a paper feeding section 12 is disposed at the lower-right side in the apparatus body 10. Further, a conveying path 14 is provided inside the apparatus body 10 so as to wind continuously from the paper feeding section 12 to an outlet 16 at the intermediate portion of the right side of the body shown in FIG. 1.

Inside the apparatus body 10, an exposing section 18 for exposing an image on a photosensitive material 40 fed from the paper feeding section 12, a development-intensification processing section 20, a cleaning section 24, a stabilizing section 25, a drying section 26, and the outlet 16 for discharging the image recording material 40 on which an image has been formed, are sequentially disposed along the conveying path 14 from the paper feeding section 12 side. Each of these sections is operated automatically by a controlling section (not shown).

Further, inside the apparatus body 10, a tank for processing solution, a tank for cleaning water and a tank for waste solution (which tanks are not shown) are also disposed.

The paper feeding section 12 of the image forming apparatus contains the photosensitive material 40 as a band-shaped image recording material which is wound in a roll configuration, and feeds a leading end portion of the photosensitive material 40 onto the conveying path 14, which leading end portion is pulled out from an outer peripheral end portion of the roll.

At several positions along the conveying path 14, feeding rollers 36 are disposed. The feeding rollers 36 feed the photosensitive material 40 from the paper feeding section 12 to the outlet 16 on the conveying path 14, by nipping the photosensitive material 40 between each pair of the rotating rollers.

The photosensitive material 40 which has been fed from the paper feeding section 12 is cut into a predetermined size by a cutter 38, which is disposed near the paper feeding section 12, and is then conveyed to the exposing section 18.

At the exposing section 18, color image signals which are input with a scanner (not shown) or the like are subjected to image processing, and then a latent image is formed by exposing the photosensitive material 40, which is at a predetermined position on the conveying path 14, by a laser light source of a semiconductor laser unit, in accordance with processed image data. The photosensitive material 40, on which the latent image has been formed in this manner, is conveyed to the development-intensification processing section 20 by the feeding rollers 36.

The development-intensification processing section 20 has the processing solution applying means, conveying means and heat controlling means. In the present first embodiment, for example, as shown in FIGS. 3–7, the processing solution applying means is structured with an applying device 310 which applies the processing solution only on a photosensitive material emulsion surface 40A which is one side of the photosensitive material 40. At a portion of the applying device 310, a jetting tank 312 is disposed.

Figure 3:
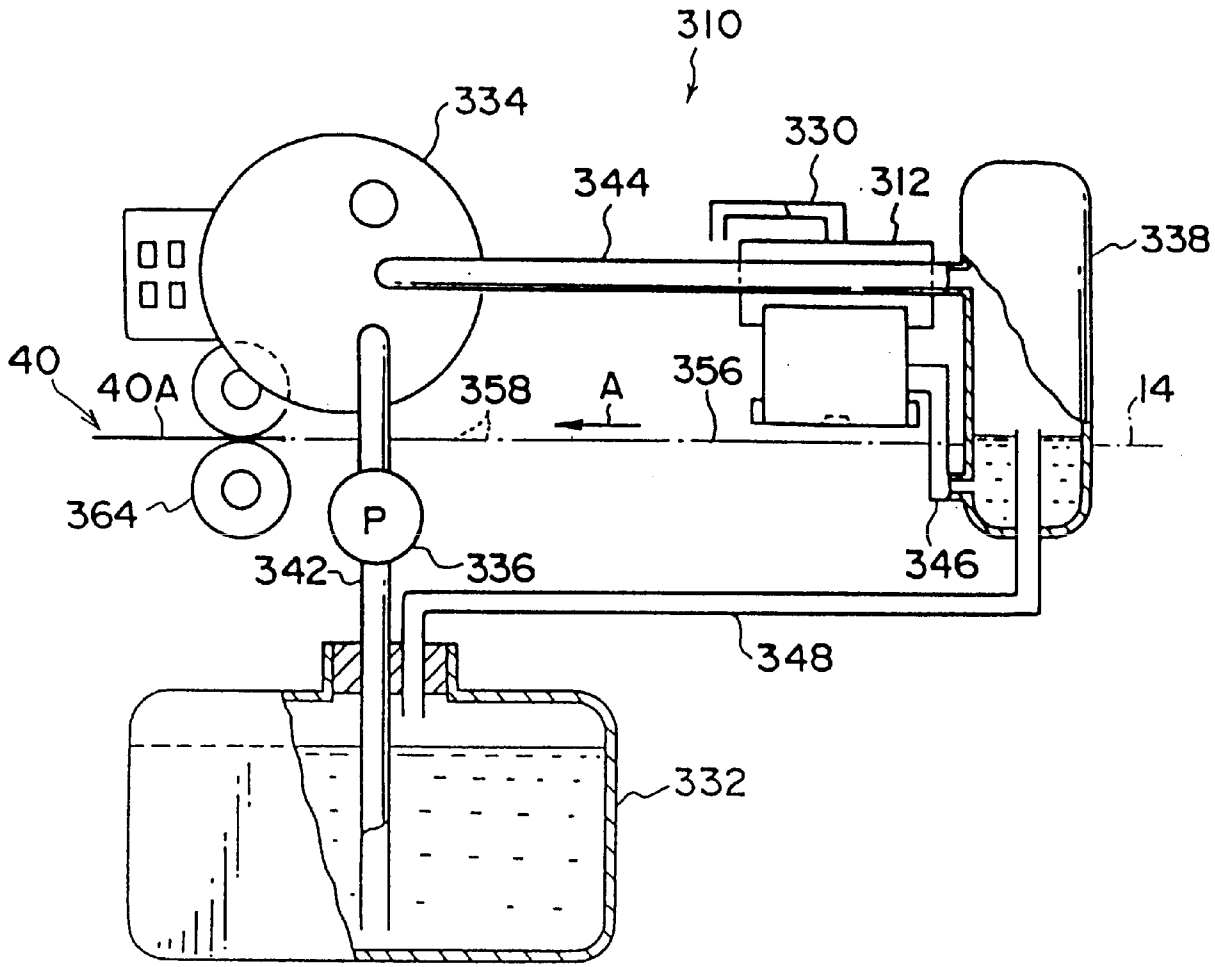
FIG. 3 is an enlarged view in rear elevation, partly in section, showing a structural example of processing solution applying means, by picking out the processing solution applying means portion of the image forming apparatus according to the first embodiment of the present invention and viewing the portion from the rear side in FIG. 1.

As shown in FIG. 3, at the lower-left side of the jetting tank 312, a processing solution bottle 332 for storing the processing solution to be supplied to the jetting tank 312 is disposed. At an upper portion of the processing solution bottle 332, a filter 334 for filtering the processing solution is disposed. A solution conveying pipe 342, which is provided with a pump 336 at an intermediate portion thereof, connects the processing solution bottle 332 and the filter 334.

Further, at the right side of the jetting tank 312 shown in FIG. 3, a sub-tank 338 for storing the processing solution conveyed from the processing solution bottle 332 is disposed. A solution conveying pipe 344 extends from the filter 334 to the sub-tank 338.

Accordingly, when the pump 336 operates, the processing solution is conveyed from the processing solution bottle 332 toward the filter 334, and the processing solution filtered by passing through the filter 334 is conveyed to the sub-tank 338, where the processing solution is temporarily stored.

A solution conveying pipe 346 is disposed between the sub-tank 338 and the jetting tank 312 so as to connect the two. The processing solution conveyed with the pump 336 from the processing solution bottle 332 through the filter 334, the sub-tank 338, the solution conveying pipe 346 and the like eventually fills the jetting tank 312.

A circulating pipe 348, one end of which is connected to the processing solution bottle 332, is connected to the sub-tank 338 in an extended state by protruding inside the sub-tank 338. The excess processing solution which has been stored in the sub-tank 338 is returned to the processing solution bottle 332 via the circulating pipe 348.

As shown in FIGS. 4–7, at a portion which is one section among wall surfaces of the jetting tank 312 and faces the conveying path 14 of the photosensitive material 40, a nozzle plate 322 formed by bending a thin, elastically deformable, rectangular plate is set.

Figure 5:
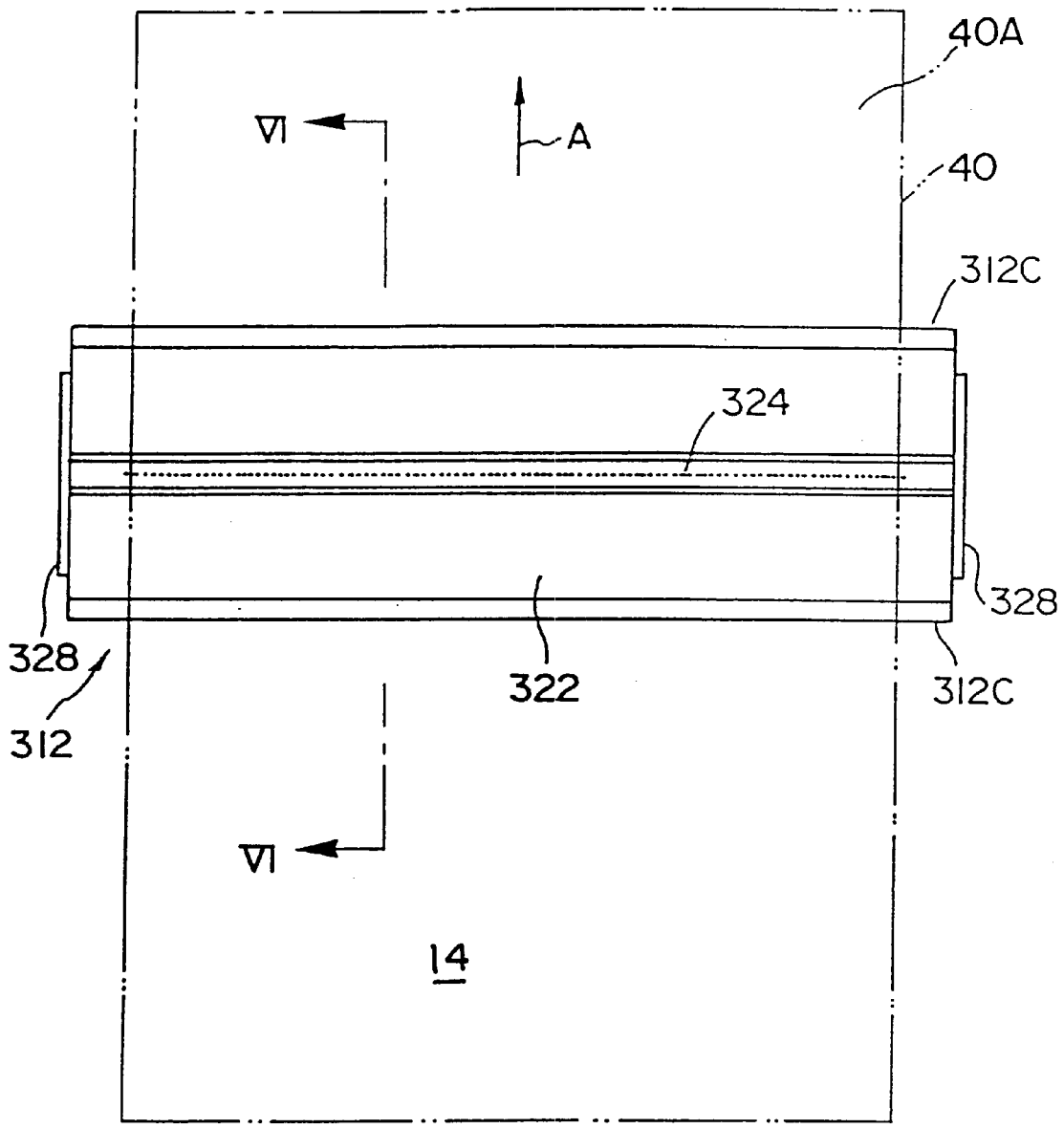
FIG. 5 is a bottom view showing a state in which a photosensitive material is conveyed under the jetting tank of the image forming apparatus according to the first embodiment of the present invention.
Figure 6:
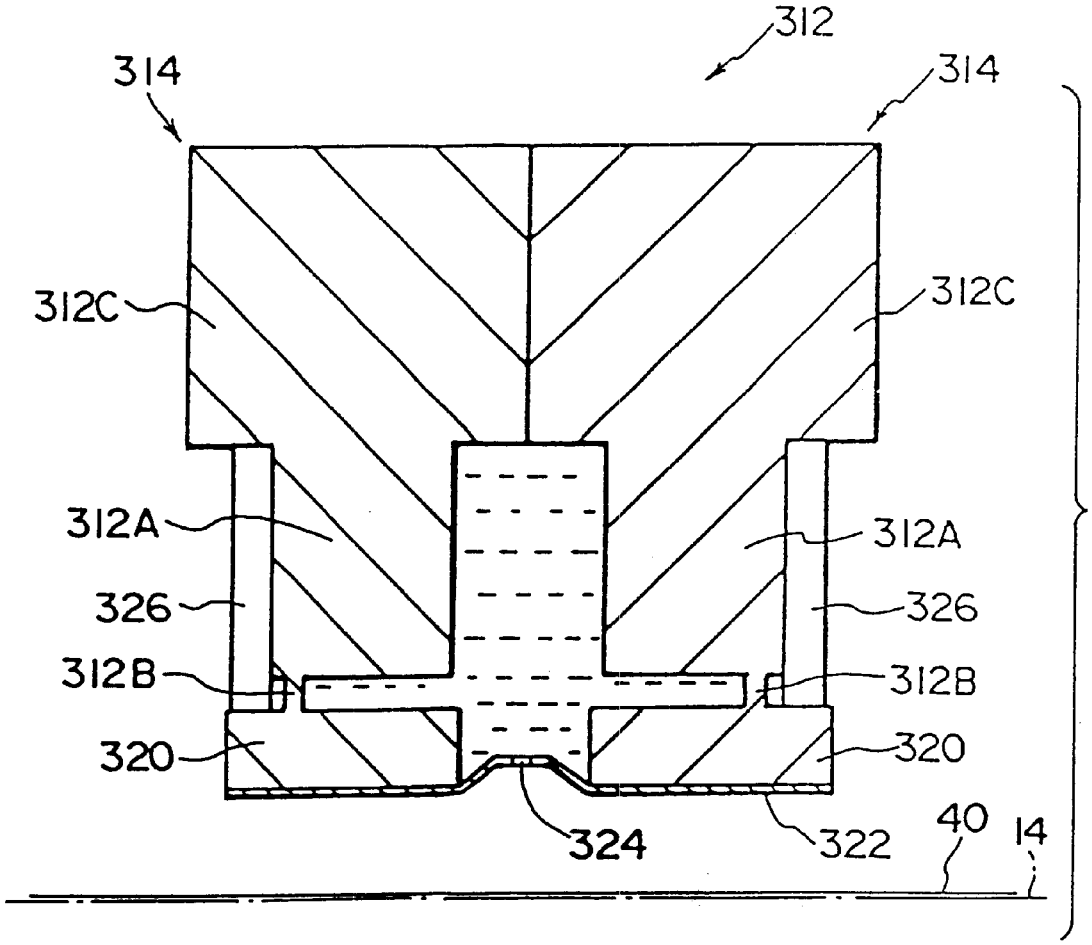
FIG. 6 is a sectional view of the jetting tank of the image forming apparatus according to the first embodiment of the present invention, wherein the jetting tank is cut along the VI—VI line in FIG. 5.

As shown in FIGS. 5 and 6, on the nozzle plate 322, a plurality of nozzle holes 324 (for example, each of which may have a diameter of several tens of $\mu$m) for jetting the processing solution which fills the jetting tank 312 are arranged linearly along the direction intersecting the conveying direction A of the photosensitive material 40, and are disposed across the entire transverse direction of the photosensitive material 40 at regular intervals. Thus the processing solution in the jetting tank 312 can be expelled from each of these nozzle holes 324 toward the photosensitive material 40.

Figure 4:
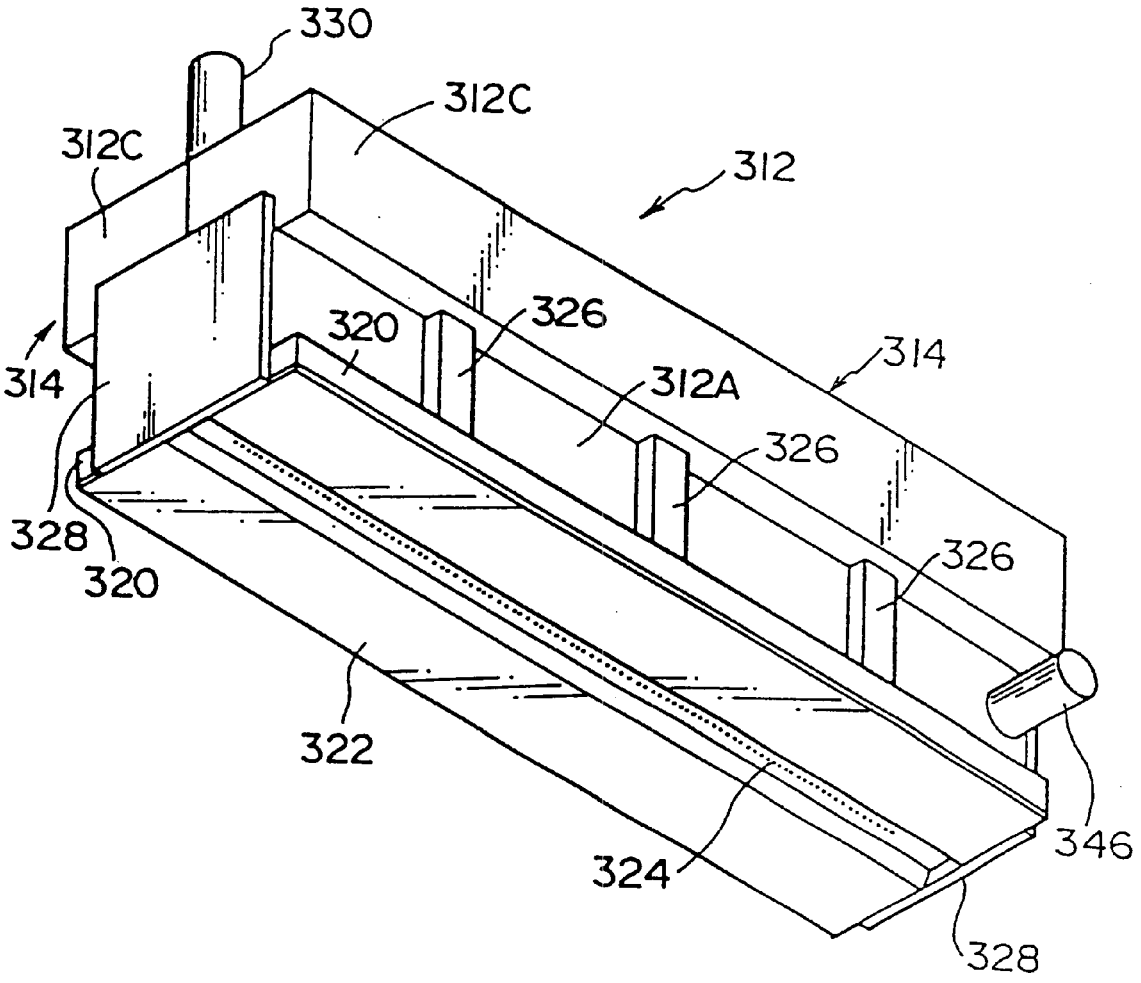
FIG. 4 is an enlarged perspective view showing a jetting tank portion of the processing solution applying means of the image forming apparatus according to the first embodiment of the present invention.

On the other hand, as shown in FIGS. 3 and 4, an exhaust duct 330 extends from an upper portion of the jetting tank 312, and enables the inside and outside of the jetting tank 312 to communicate. Further, a valve (not shown) for opening and closing the exhaust duct 330 is set at an intermediate portion of the exhaust duct 330. Due to opening and closing movements of the valve , the inside of the jetting tank 312 can be made to communicate with or be closed off from the outside air.

As shown in FIG. 6, end side portions of the nozzle plate 322, which orthogonally intersect the longitudinal direction of the plurality of which are the nozzle holes 324, which are arranged linearly, are adhered with an adhesive or the like and are fixed to a pair of lever plates 320, respectively. The nozzle plate 322 and the pair of the lever plates 320 are thereby connected. The pair of the lever plates 320 are fixed to a pair of side walls 312A via a pair of small-width supporting portions 312B, respectively, wherein each of the supporting portions 312B is formed at a lower portion of the respective side wall 312A of the jetting tank 312.

On the other hand, a pair of top walls 312C, which form a top surface of the jetting tank 312 by abutting each other, partially protrude to the outside of the jetting tank 312. At the respective lower side of the protruding top walls 312C, a plurality of piezoelectric elements 326 (in the present first embodiment, each side has three piezoelectric elements) serving as an actuator, are adhered and disposed to bottom surfaces of the piezoelectric elements 326, and outer end sides of the lever plates 320 are adhered, respectively, so that the piezoelectric elements 326 and the lever plates 320 are connected.

Each of the lever plates 320, the side walls 312A, the supporting portions 312B and the top walls 312C forms a portion of an integrally formed frame 314. As shown in FIG. 6, due to a pair of the frames 314 being put together and screwed down with bolts (not shown), the pair of the lever plates 320, the pair of the side walls 312A, the pair of the top walls 312C and the pair of the supporting portions 312B are disposed so that respective members of the pairs face each other, and together for m an outer frame of the jetting tank 312.

As shown in FIGS. 4 and 5, at each of portions defined by right and left ends of the nozzle plate 322 , which are end portions of the nozzle plate 322 located in the longitudinal direction of the nozzle holes 324, and by end portions of the pair of the frames 314, a thin sealing plate 328 is disposed so as to adhere to the respective frame 314.

Further, at inner sides of the sealing plates 328, an elastic adhesive, for example, that of a silicone rubber type, fills the openings between the sealing plates 328 and the right and left ends of the nozzle plate 322 and the openings between the sealing plates 328 and the end portions of the pair of the frames 314, in order to prevent the processing solution from leaking therefrom. Accordingly, the openings of the jetting tank 312 is sealed by the elastic adhesive without inhibiting the movement of the right and left ends of the nozzle plate 322. It is also possible to seal right and left ends of the jetting tank 312 using only the elastic adhesive, without using the thin sealing plates 328.

Figure 7:
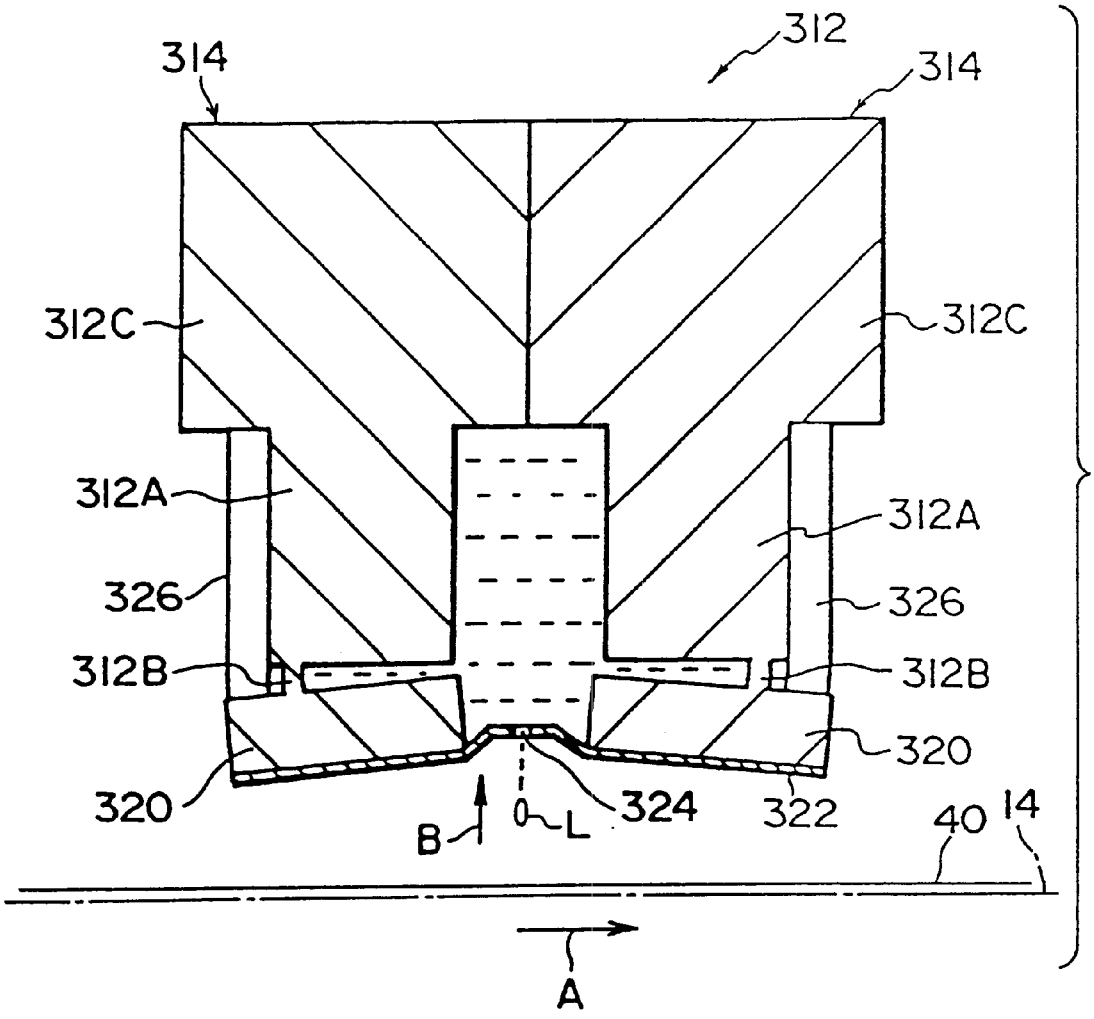
FIG. 7 is a sectional view showing a state in which water is jetted from the jetting tank of the image forming apparatus according to the first embodiment of the present invention, in a cross-section corresponding to FIG. 6.

Due to the above, when the piezoelectric elements 326 are energized by the power source, the piezoelectric elements 32 6 lengthen and rotate the lever plates 320 a bout the supporting portions 312B, as shown in FIG. 7. Together with this rotation, the piezoelectric elements 326 simultaneously deform and displace the nozzle plate 322 so that a middle portion of the nozzle plate 322 rises along the direction of arrow B. Together with the deformation of the nozzle plate 322, pressure of the processing solution in the jetting tank 312 simultaneously increases, such that a small amount of the processing solution L is jetted linearly from the nozzle holes 324.

As shown in FIG. 1, at a position that faces the jetting tank 312 at the side of the conveying path 14 opposite thereto, the holding means is provided in order to prevent the nozzle holes 324 from clogging, wherein the clogging is caused by evaporation of the water content of the processing solution and by deposition of components thereof at the nozzle holes 324 portion of the jetting tank 312. This occurs when the jetting tank 312 is not being used and the nozzle holes 324 do not perform an operation of atomizing the processing solution after the atomizing operation.

The holding means comprises a pan member 352 which has a substantially U-shaped cross-section and which can be operated to move in the direction of arrow C in FIG. 1. When the jetting tank 312 performs the operation of atomizing the processing solution, the pan member 352 is located at a position vertically downward from the conveying path 14 and just below the nozzle holes 324, and is used to catch the droplets of the processing solution which have been jetted from the nozzle holes 324 and have not been deposited on the photosensitive material 40.

For times when the jetting tank 312 is not being used, the pan member 352 is moved in the vertically upward direction and the nozzle holes 324 portion of the jetting tank 312 is immersed in the solution stored to a predetermined level in a recessed portion of the pan member 352 so as to prevent the nozzle holes 324 portion from drying and clogging. Further, the recessed portion of the pan member 352 may be filled with the cleaning solution to perform cleaning of the nozzle holes 324 as needed.

Figure 8:
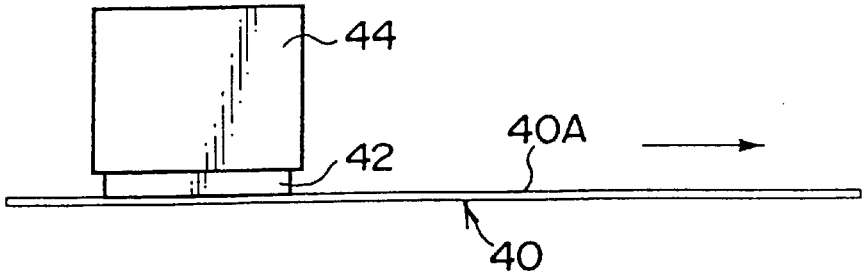
FIG. 8 is a side view illustrating a schematic structure of the processing solution applying means in a felt pen form, which can be structured as the processing solution applying means of the image forming apparatus according to the first embodiment of the present invention.

The previously described processing solution applying means may have structures other than the above-described structure such as those shown in FIGS. 8–11. The means shown in FIG. 8 is structured in a so-called felt form, wherein the processing solution for processing the photosensitive material 40 is applied only on the photosensitive material emulsion surface 40A which is one side of the photosensitive material 40, by sliding a felt applying member 42 soaked with the processing solution.

In the processing solution applying means in the felt form, the processing solution is supplied by processing solution supplying means (not shown) from a tank for the processing solution to the felt applying member 42 formed with a blade-shaped felt material which is an elastic body having a water absorbing property. Further, the amount of the processing solution to be supplied is controlled by processing solution supply controlling means 44.

Figure 9:
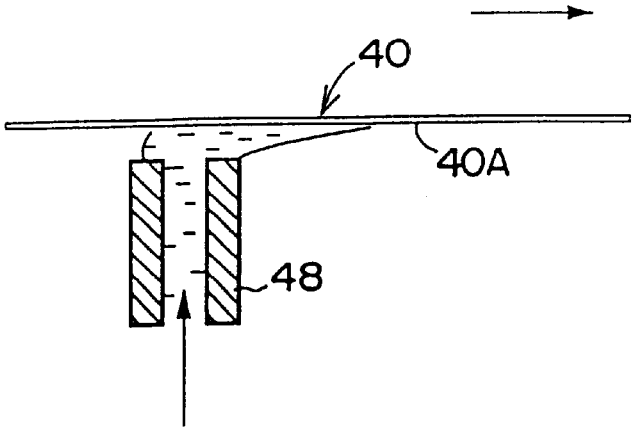
FIG. 9 is a sectional view illustrating a schematic structure of the processing solution applying means in a geyser form, which can be structured as the processing solution applying means of the image forming apparatus according to the first embodiment of the present invention.

The processing solution applying means shown in FIG. 9 is structured in a so-called geyser form. In processing solution applying the means, viscous processing solution is extruded from a slit member 48 and is smeared only on the photosensitive material emulsion surface 40A which is one side of the photosensitive material 40.

Figure 10:
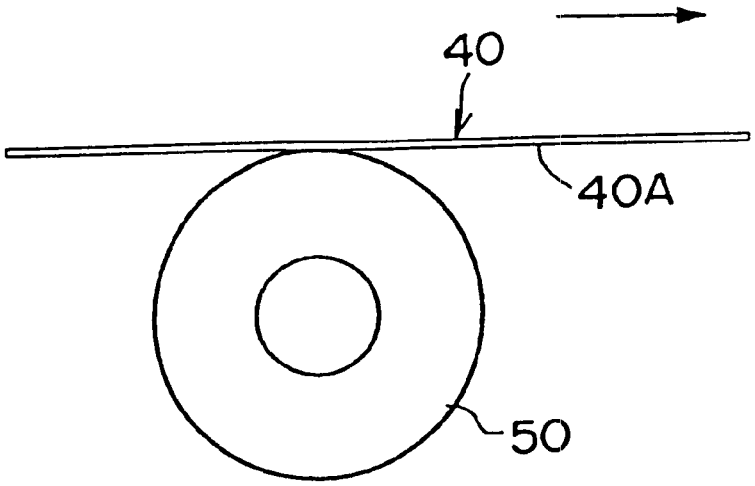
FIG. 10 is a side view illustrating a schematic structure of the processing solution applying means in a porous roller form, which can be structured as the processing solution applying means of the image forming apparatus according to the first embodiment of the present invention.

The processing solution applying means shown in FIG. 10 is structured in a so-called porous roller form. In the means, the processing solution is applied by rolling a porous roller 50 only on the photosensitive material emulsion surface 40A which is one side of the photosensitive material 40 after the processing solution is supplied to and soaks the porous roller 50.

Figure 11:
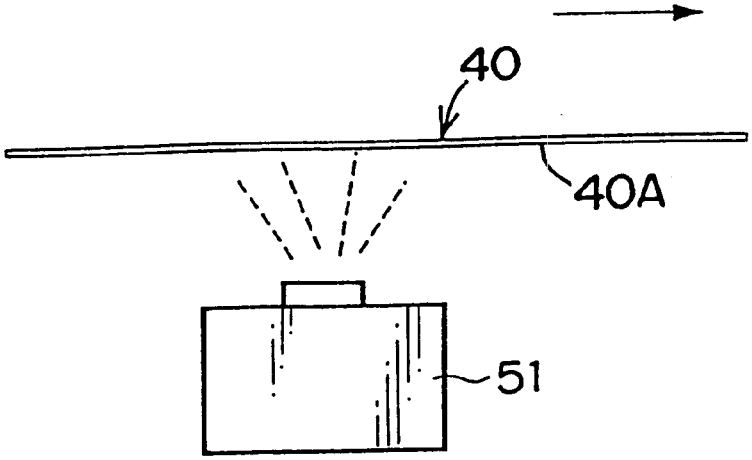
FIG. 11 is a side view illustrating a schematic structure of the processing solution applying means in a spray form, which can be structured as the processing solution applying means of the image forming apparatus according to the first embodiment of the present invention.

The processing solution applying means shown in FIG. 11 is structured in a so-called spray form. In the processing solution applying means, the processing solution is sprayed and applied with a spraying device 51 only on the photosensitive material emulsion surface 40A which is a bottom surface of the photosensitive material 40.

In the development-intensification processing section 20 structured as previously described, at the upstream side of the conveying means, a first developing intensifier is applied on the photosensitive material emulsion surface 40A of the conveyed photosensitive material 40 by the processing solution applying means. The photosensitive material 40, on which the first developing intensifier has been applied in this manner, is heated by the heat controlling means, and is then conveyed by the conveying means while being kept at a predetermined temperature. During the conveyance, a chemical reaction is caused and the development-intensification processing is completed, and then the photosensitive material 40 is conveyed to the cleaning section 24, which is next.

The development-intensification processing section 20 is not limited to the previously described structure, and may have other various structures.

As shown in FIG. 1, a heat-control section 354 is provided at a position that is on the conveying path 14 of the photosensitive material 40 and is at the downstream side in the direction the photosensitive material 40 is conveyed from the jetting tank 312. The heat-control section 354 has a belt conveyer 356 (360, 362) as conveying means which is disposed along and just below the conveying path 14, and a case portion 358 as the heat controlling means which covers the belt conveyer 356 so as to envelop it.

In the belt conveyer 356, an endless belt 362 for conveyance is wound between a pair of rollers 360 so that it can convey the photosensitive material 40 disposed on the endless belt 362 in the direction of arrow A. The belt conveyer 356 may be structured in a so-called gel-belt form, in which a sticky condition imparted to an outer surface of the endless belt 362, and the photosensitive material 40 is thereby conveyed in the state of being adhered to the endless belt 362 so as not to be blown off.

In the case portion 358, an inlet opening 366 for introducing the photosensitive material 40, which opens correspondingly to an inlet at the upstream side of the belt conveyer 356 on the conveying path 14, and an outlet opening 368 for discharging the photosensitive material 40, which opens correspondingly to an outlet at the downstream side thereof, are provided.

In the case portion 358, the air is kept at a predetermined temperature by a heater (not shown). Therefore, the inside of the case portion 358 is adjusted so that the emulsion surface 40A portion of the photosensitive material 40, having the first developing intensifier applied thereon, is kept at a predetermined temperature, and chemical change proceeds at a predetermined speed, when the photosensitive material 40 passes through the case portion 358.

At a position which is on the conveying path 14 and near the outlet opening 368, conveying rollers 364 are disposed. The pair of the conveying rollers 364 squeeze off the spent excess first developing intensifier which is deposited on the photosensitive material 40, and conveys the photosensitive material 40 by rotating while nipping the photosensitive material 40 therebetween.

The photosensitive material 40, which has been processed at the above-described development-intensification processing section 20, is conveyed to the cleaning section 24 on the conveying path 14. The cleaning section 24 is means for post-processing which is a step for ensuring preservation properties of the image formed on the photographic material 40.

As shown in the total schematic structural view of the image forming apparatus in FIG. 1, the cleaning section 24 cleans the emulsion surface 40A of the photosensitive material 40 by splashing a necessary amount of the cleaning water only on the emulsion surface 40A with a shower device 52. The shower device 52 is a non-contacting type applying means. By using the shower device 52 in this manner, the cleaning water can be splashed on the emulsion surface 40A in a non-contact state such that a portion of the shower device 52 does not touch the emulsion surface 40A. It is desirable to dispose wetting prevention means which prevents a surface opposite to the emulsion surface 40A of the photosensitive material 40 from being wet with the cleaning water during the splashing.

At a position which is below the shower device 52 and which is at the side of the conveying path 14 opposite thereto, a pan 54 for the cleaning water is provided. The pan 54 is disposed under the conveying path from the shower device 52 with respect to squeezing rollers 56, which are disposed at the downstream side of the conveying path 14 from the shower device 52, and catches spilt cleaning water.

The pair of the squeezing rollers 56 squeeze off the cleaning water on the emulsion surface 40A by rotating while nipping the photosensitive material 40 therebetween. The split cleaning water caught by the pan 54 is reclaimed to be reused, or disposed of, as waste solution. The photosensitive material 40, from which the cleaning water has been squeezed by the squeezing rollers 56, is conveyed to the stabilizing section 25. The stabilizing section 25 is disposed at a position downstream the conveying path 14.

At the stabilizing section 25, stabilizing processing is performed by splashing a first stabilizing solution on the emulsion surface 40A of the photosensitive material 40 with a shower device 58. The shower device 58 is a non-contacting type applying means. Further, at the stabilizing section 25, the first stabilizing solution on the photosensitive material 40 is squeezed off by squeezing rollers 60, and the spilt first stabilizing solution is caught by a pan 62. The shower device 58, the squeezing rollers 60 and the pan 62 are structured in the same manner as the shower device 52, the squeezing rollers 56 and the pan 54 of the previously described cleaning section 24, respectively.

The photosensitive material 40, for which the stabilizing processing has been completed at the stabilizing section 25, is conveyed to the drying section 26, which is downstream the conveying path 14. The drying section 26 is structured as a drying system by heat rollers and hot air blowing. That is, in order to dry the emulsion surface 40A, the portion on the conveying path 14 which corresponds to the drying section 26 is covered with a cover member 64, and hot air is blown on the emulsion surface 40A of the photosensitive material 40 inside the cover member 64. Further, heat rollers 66 heated to a predetermined temperature are rotated while contacting the photosensitive material 40 to dry the emulsion surface 40A, while performing a conveying operation.

The photosensitive material 40, which has been dried at the drying section 26 in this manner and on which the image has been formed, is conveyed as a finished product from the outlet 16 onto a tray portion 10A, which is mounted so as to protrude from a side portion of the apparatus body 10. The photosensitive material 40 is eventually stacked on the tray portion 10A.

Next, the photosensitive material 40 used in the image forming apparatus of the first embodiment, and each of the processing solutions will be described.

The photosensitive material 40 used in this image forming apparatus is the photosensitive material 40 containing a color developing agent and the like, and a construction thereof will be described hereinafter.

(Photosensitive material)

(1) Silver halide color photographic photosensitive material, which has at least one photographic structuring layer on a support, and includes in any of the photographic structuring layers at least one dye-forming coupler and at least one reducing agent for coloring represented by the following general formulas (I) and/or (II).

General formula (I)

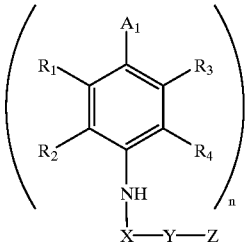

General formula (II)

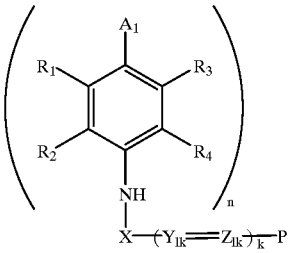

In the above formulas, $R_1$–$R_4$ each independently represent a hydrogen atom or a substituent. $A_1$ and $A_2$ each represent a hydroxyl group or a substituted amino group. X represents a polyvalent connecting group selected from —CO—, —SO—, —$SO_2$ and —PO<. $Y_{1K}$ and $Z_{1K}$ represent a nitrogen atom or a group represented by —$CR_5$=($R_5$ is a hydrogen atom or a substituent). k represents an integer which is 0 or more. P represents a proton dissociative group or a group which can be a cation, and has a function of forming dye with a process in which an oxidant produced by redox reaction between the present compound and the exposed silver halide couples with a coupler, and thereafter electron-transfer from P triggers cutting of N—X bonding and elimination of the substituent bonded to the coupling portion of the coupler. Y represents a bivalent connecting group. Z represents a nucleophilic group which can attack X when the present compound is oxidized. n is 1 or 2 when X is —PO<, and is 1 when X is another group. $R_1$ and $R_2$, $R_3$ and $R_4$, and two or more atoms or substituents selected arbitrarily from $Y_{1K}$, $Z_{1K}$, and P, may each be independently linked with each other to form a ring.

(2) Silver halide color photographic photosensitive material, which has at least one photographic structuring layer on a support, and includes in any of the photographic structuring layers at least one dye-forming coupler and at least one reducing agent for coloring represented by the following general formula (III).

$R^{11}$—NHNH—$X^0$—$R^{12}$ General formula (III)

In the above formula, $R^{11}$ is an aryl group or a hetero ring group which may have a substituent, and $R^{12}$ is an alkyl group, an alkenyl group, an alkynyl group, an aryl group or a hetero ring group which may have a substituent. $X^0$ is —$SO_2$—, —CO—, —COCO—, —CO—O—, —CONH($R^{13}$)—, —COCO—O—, —COCO—N($R^{13}$)— or —$SO_2$—NH($R^{13}$)—, wherein $R^{13}$ is a hydrogen atom or a group described with regards to $R^{12}$.

(3) Photosensitive material as described above in (2) in which the compound represented by the general formula (III) is represented by the following general formulas (IV) or (V).

General formula (IV)

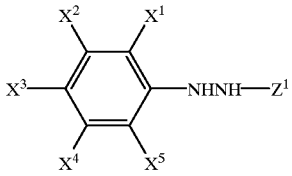

General formula (V)

$R^{3a}$—NHNH—$Z^2$

In the above formulas, $Z^1$ represents an acyl group, a carbamoyl group, an alkoxycarbonyl group or an aryloxycarbonyl group, $Z^2$ represents a carbamoyl group, an alkoxycarbonyl group or an aryloxycarbonyl group, and $X^1$, $X^2$, $X^3$, $X^4$ and $X^5$ each represent a hydrogen atom or a substituent. However, the sum of Hammett's substituent constant σp of $X^1$, $X^3$ and $X^5$ and Hammett's substituent constant σm of $X^2$ and $X^4$ is within a range from 0.08 to 3.80. $R^{3a}$ represents a hetero ring group.

(4) Photosensitive material as described above in (3) in which the compounds represented by the general formulas (IV) and (V) are represented by the following general formulas (VI) and (VII), respectively.

General formula (VI)

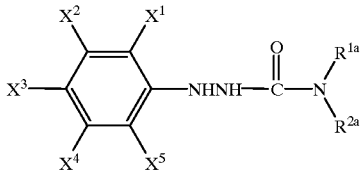

General formula (VII)

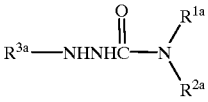

In the above formulas, $R^{1a}$ and $R^{2a}$ each represent a hydrogen atom or a substituent, and $X^1$, $X^2$, $X^3$, $X^4$ and $X^5$ each represent a hydrogen atom or a substituent. However, the sum of Hammett's substituent constant σp of $X^1$, $X^3$ and $X^5$ and Hammett's substituent constant σm of $X^2$ and $X^4$ is within a range from 0.80 to 3.80. $R^{3a}$ represents a hetero ring group.

(5) Photosensitive material as described above in (4) in which the compounds represented by the general formulas (VI) and (VII) are represented by the following general formulas (VIII) and (IX), respectively.

General formula (VIII)

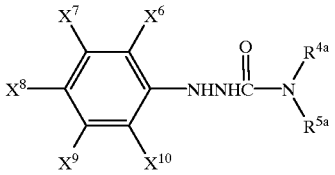

General formula (IX)

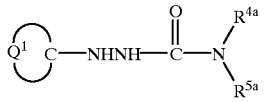

In the above formulas, $R^{4a}$ and $R^{5a}$ each represent a hydrogen atom or a substituent, either $R^{4a}$ or $R^{5a}$ is a hydrogen atom, and $X^6$, $X^7$, $X^8$, $X^9$ and $X^{10}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group or a hetero ring group. However, the sum of Hammett's substituent constant σp of $X^6$, $X^8$ and $X^{10}$ and Hammett's substituent constant σm of $X^7$ and $X^9$ is within a range from 1.20 to 3.80.

$Q^1$ represents a non-metallic atom group which is necessary to form a hetero ring of 5–8 member ring including nitrogen together with C.

In the photosensitive material according to the present embodiment, it is desirable that the total amount of silver of the silver halide contained in all applied layers is 0.03–0.3 g/m$^2$.

The reducing agent for coloring is preferably used in an amount of 0.01–10 mmol/m$^2$ per coloring layer in order to obtain sufficient density of the formed color. A more preferable amount for use thereof is of 0.05–5 mmol/m$^2$, and an especially preferable amount for use is of 0.1–1 mmol/m$^2$. If the amount is within this range, sufficient density of the formed color can be obtained.

Further, the amount of the coupler in coloring layers in which the reducing agent for coloring is used, is preferably 0.05–20 times as large as the amount of the reducing agent for coloring on the basis of mol conversion, more preferably 0.1–10 times, and especially preferably 0.2–5 times. If the amount is within this range, sufficient density of the formed color can be obtained.

| First developing intensifier | |
|---|---|
| water | 800 ml |
| sodium 5-sulfosalicylate | 50 g |
| benzotriazole | 0.02 g |
| KCl | 2.5 g |
| hydroxyethylidene-1,1-diphosphonic acid (30% aqueous solution) | 4 ml |
| hydrogen peroxide (30% aqueous solution) | 30 ml |
| Further, water was added to the above such that the total amount of the solution was 1 liter | |
| pH | 11.5 |

-continued

| First stabilizing solution | |
|---|---|
| potassium carbonate | 15 g |
| sodium 2-mercaptobenzimidazole-5-sulfonate | 1 g |
| hydroxyethylidene-1,1-diphosphonic acid (30% aqueous solution) | 1 ml |
| 5-chloro-2-methyl-4-isothiazoline-3-one | 0.02 g |
| Further, water was added to the above such that the total amount of the solution was 1 liter | |
| pH | 9.5 |

Figure 2:
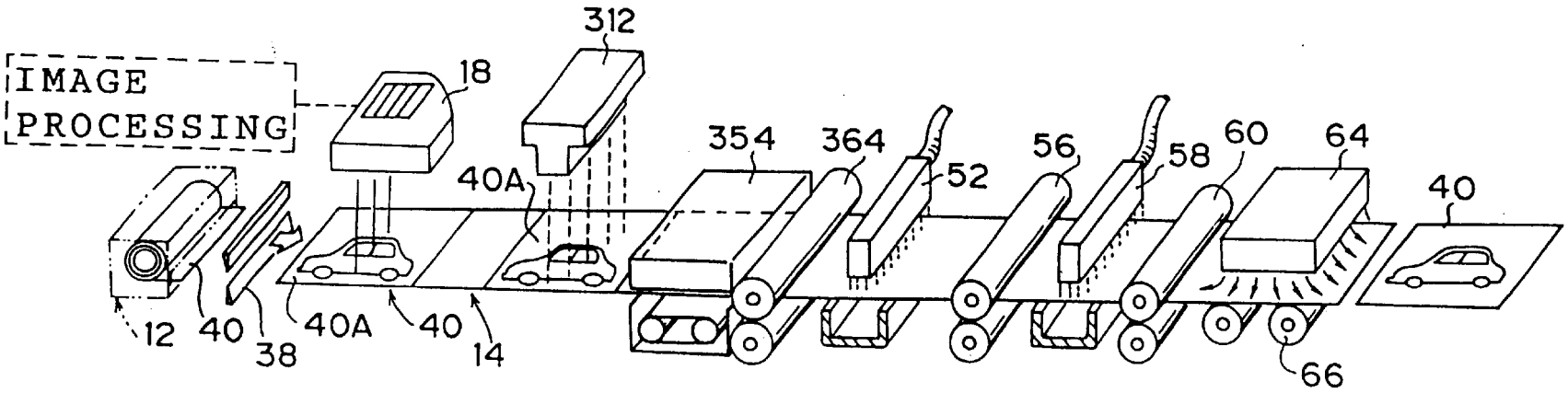
FIG. 2 is a schematic perspective view showing a flow of processing steps of the image forming apparatus according to the first embodiment of the present invention.

Next, the operation and the method of using the image forming apparatus structured in the above-described manner will be explained with reference to FIGS. 1 and 2. Initially, image signals for an original document with an image are input by using the scanner or the like, and are subjected to the image processing, so as to prepare the exposing section 18 for operation.

Subsequently, when a command for forming the image of the original document on the photosensitive material 40 is input to the controlling section (not shown) of the apparatus body 10, the paper feeding section 12 is operated by the command of the controlling section, and the band-shaped photosensitive material 40 is fed onto the conveying path 14. The photosensitive material 40, which has been fed a predetermined length onto the conveying path 14 in this manner, is cut into a predetermined size by the cutter 38, and is then conveyed to the exposing section 18.

At the exposing section 18, the emulsion surface 40A which is one side of the photosensitive material 40 is exposed in accordance with an image-processed data to form a latent image which corresponds to the image on the original document, and then the photosensitive material 40 is conveyed to the development-intensification processing section 20. At the development-intensification processing section 20, the first developing intensifier is applied on the emulsion surface 40A of the photosensitive material 40 by the applying device 310 serving as the processing solution applying means, and the photosensitive material 40 is subjected to the developing processing for 20 seconds during which the photosensitive material 40 is conveyed 280 mm on the conveying path 14 at a predetermined temperature (40° C.). Thereafter, the excess first developing intensifier thereon is squeezed off by the rollers 364, and then the photosensitive material 40 is conveyed to the cleaning section 24.

At the cleaning section 24, the cleaning water is splashed on the emulsion surface 40A of the photosensitive material 40 by the shower device 52, the photosensitive material 40 is rinsed for 5 seconds to remove alkaline components during which the photosensitive material 40 is conveyed 140 mm on the conveying path 14, and the residual cleaning water deposited on the photosensitive material 40 is squeezed off by the squeezing rollers 56. Next, the photosensitive material 40 is conveyed to the stabilizing section 25. At the stabilizing section 25, the first stabilizing solution is splashed on the emulsion surface 40A of the photosensitive material 40 by the shower device 58, the photosensitive material 40 is subjected to the stabilizing processing (silver-removing processing) for 5 seconds during which the photosensitive material 40 is conveyed 70 mm on the conveying path 14, and the first stabilizing solution deposited on the photosensitive material 40 is squeezed off by the squeezing rollers 60. Next, the photosensitive material 40 is conveyed to the drying section 26.

At the drying section 26, primarily the emulsion surface 40A of the photosensitive material 40 wetted with the processing solution is dried for 10 seconds during which the photosensitive material 40 is conveyed 140 mm on the conveying path 14, and then the photosensitive material 40 is conveyed from the outlet 16 onto the tray 10A as a finished product on which the image has been formed. As a result, a series of controlling operations for the image forming processing is completed.

FIRST EXAMPLE

A first example, in which the image forming apparatus in the present first embodiment is structured such that the stabilizing section 25 is disposed at a position along the conveying path 14 that is upstream with respect to the cleaning section 24, will be described next.

Inside the apparatus body 10, the following are disposed in sequence from the paper feeding section 12 side: the exposing section 18 for exposing the photosensitive material 40, which is the image recording material conveyed from the paper feeding section 12, to form an image; next, the development-intensification processing section 20; thereafter, the stabilizing section 25; followed by the cleaning section 24, the drying section 26, and the outlet 16. The outlet 16 is for discharging the image recording material on which the image has been formed.

In the present first example the mechanical structure of the stabilizing section 25 and the cleaning section 24 are equivalent to each other. The first stabilizing solution is jetted with the shower device 52 to effect stabilizing processing of the emulsion surface 40A, which is one side of the photosensitive material 40. Next, the cleaning water is jetted with the shower device 58 to effect cleaning processing of the emulsion surface 40A.

The photosensitive material 40 and processing solutions such as the first developing intensifier and the first stabilizing solution used in the image forming apparatus of the present first example are the equivalents of those in the above-described first embodiment.

Further, according to the structure of the present first example, after the stabilizing processing is effected for the emulsion surface 40A, the cleaning processing is effected therefor. Accordingly, after these steps, there is no residual first stabilizing solution on the emulsion surface 40A. Thus, subsequent processing of the emulsion surface 40A to remove alkaline components can be made unnecessary.

SECOND EXAMPLE

A second example will be described next. In the second example, image processings will be effected using processing solution and post-processing solution that differ from those described above, in the image forming apparatus in the present first embodiment having the structure shown in FIG. 1.

In the image forming apparatus according to this second example, the processing solution and the post-processing solution having compositions as indicated below.

| Second developing intensifier (Solution by mixing equal amounts of second alkaline processing solution and second solution including hydrogen peroxide) | |
|---|---|
| Second alkaline processing solution (Activator solution) | |
| water | 700 ml |
| potassium hydroxide | 44 g |
| potassium chloride | 1.25 g |
| benzotriazole | 0.01 g |
| hydroxyethylidene-1,1-diphosphonic acid (30% aqueous solution) | 4 ml |
| compound represented by Cpd-2 below | 5 g |
| surfactant (compound represented by W-1 below) | 0.2 g |
| Further, water was added to the above such that the total amount of the solution was 1 liter | |
| Second solution including hydrogen peroxide | |
| water | 800 ml |
| hydrogen peroxide (30% aqueous solution) | 30 ml |
| hydroxyethylidene-1,1-diphosphonic acid (30% aqueous solution) | 4 ml |
| compound represented by Cpd-2 below | 5 g |
| Further, water was added to the above such that the total amount of the solution was 1 liter | |
| pH | 5.5 |
| Second stabilizing solution (post-processing solution which is an acidic solution) | |
| citric acid (anhydride) | 30 g |
| agent which forms a complex compound with silver (compound represented by Cpd-1 below) | 36 g |
| surfactant (compound represented by W-1 below) | 0.2 g |
| Further, water was added to the above such that the total amount of the solution was 1 liter | |
| pH | 2 |

Cpd-1

-continued

| Second developing intensifier (Solution by mixing equal amounts of second alkaline processing solution and second solution including hydrogen peroxide) |
|---|
| 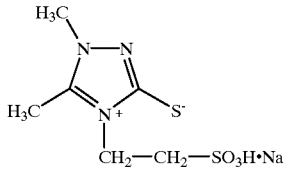 Cpd-2 |
| 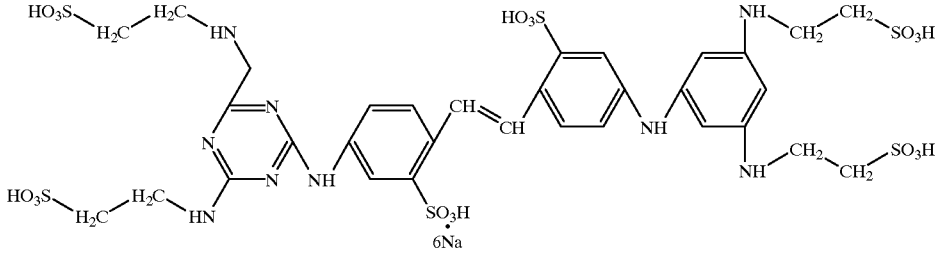 W-1 |
| 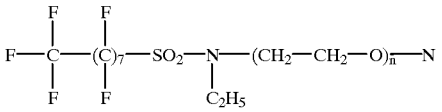 n = 14 |

Operation and method of use of the image forming apparatus relating to the second example structured as described above will be described next, with reference to FIGS. 1 and 2. First, image signals of an original document are input by using the scanner of the like, and are subjected to the image processing, so as to prepare the exposing section 18 for operation.

Subsequently, when a command for forming the image of the original document on the photosensitive material 40 is input to the controlling section (not shown) of the apparatus body 10, the paper feeding section 12 is operated by the command of the controlling section, and the band-shaped photosensitive material 40 is fed onto the conveying path 14. The photosensitive material 40, which has been fed a predetermined length onto the conveying path in this matter, is cut into a predetermined size by the cutter 38, and is then conveyed to the exposing section 18.

At the exposing section 18, the emulsion surface 40A which is one side of the photosensitive material 40, is exposed in accordance with an image processed-data to form a latent image which corresponds to the image on the original document. The photosensitive material 40 is then conveyed to the development-intensification processing section 20. At the development intensification processing section 20, the second developing intensifier (a processing solution produced by mixing equal amounts of the second alkaline processing solution and the second solution including hydrogen peroxide) at a predetermined temperature (approximately of from 35 to 45° C.) is applied onto the emulsion surface 40A of the photosensitive material 40. The second developing intensifier is applied with the applying device 310 serving as the processing solution applying means. The photosensitive material 40 is then subjected to the developing processing for 18 seconds, during which the photosensitive material 40 is conveyed on the conveying path 14, which is on a heat panel. The heat panel is means for adjusting heating temperature of the development-intensification processing section 20 and adjusts the temperature to approximately 40° C. Thereafter, the excess second developing intensifier is squeezed off by the rollers 364, and the photosensitive material 40 is conveyed to the cleaning section 24.

Next, at the cleaning section 24, which serves as the post-processing means for ensuring preservation properties of the image formed on the photosensitive material 40, cleaning water is splashed on the emulsion surface 40A of the photosensitive material 40 with the shower device 52. The photosensitive material 40 is rinsed while being conveyed on the conveying path 14 so as to remove alkaline components from the emulsion surface 40A. The residual cleaning water is squeezed off by the squeezing rollers 56. Next, the photosensitive material 40 is conveyed to the stabilizing section 25.

At the stabilizing section 25, the second stabilizing solution is splashed onto the emulsion surface 40A of the photosensitive material 40. The second stabilizing solution is splashed with the shower device 58 (another non-contacting type processing solution applying means using the jetting tank 312 of the applying device 310 or the like may be used instead of the shower device 58). The photosensitive material 40 is subjected to the stabilizing processing while being conveyed on the conveying path 14. In the stabilizing processing, residual silver on the emulsion surface 40A of the photosensitive material 40 forms a complex compound with the second stabilizing solution. Thereafter, the second stabilizing solution deposited on the photosensitive material 40 is squeezed off by the squeezing rollers 60, and the photosensitive material 40 is conveyed to the drying section 26.

At the drying section 26, the emulsion surface 40A of the photosensitive material 40 wetted with the processing solution is dried while the photosensitive material 40 is conveyed on the conveying path 14. The photosensitive material 40 is then conveyed from the outlet 16 onto the tray 10A as a finished product on which the image has been formed. As a result, a series of controlling operations for the image forming processing is completed.

The processing in each of the above-described operation processes is performed only for the emulsion surface 40A which is one side of the photosensitive material 40. Accordingly, compared with the case in which both the emulsion surface 40A of the photosensitive material 40 and the surface opposite to the emulsion surface 40A are wetted in the same manner, such as in a conventional so-called dipping method or the like, the amount of the processing solution to be applied can be reduced and the deterioration of the entire processing solution can be decreased. This is because each processing solution needs to be applied and the cleaning and stabilizing processings need to be performed only on the emulsion surface 40A which is one side of the photosensitive material 40. Further, compared with the case in which the entirety of the two surfaces of the photosensitive material 40 are dried in the same manner, the time for drying can be shortened and thus the time for processing can be shortened considerably, because the emulsion surface 40A side of the photosensitive material 40 is primarily required to be dried.

Plural series of routes, in which the previously described processing operations such as exposing, developing, bleach-fixing, cleaning, drying and the like are performed, may be provided in the image forming apparatus.

In the structure of the present first embodiment, the conventional so-called dipping method is not used in the image forming apparatus. Accordingly, a large-sized processing solution tank for dipping the photosensitive material is not needed. In addition, a conveying path that winds considerably in the vertical direction, i.e., a conveying path that extends from outside and above the processing solution in the processing solution tank into the processing solution and then extends to outside and above the processing solution again, does not need to be set.

As a result, a flat conveying path for the photosensitive material can be set, which does not wind considerably in the vertical direction. Further, in the structure of the present first embodiment, the processing solution is used up, and waste solution does not remain. Therefore, a large-sized waste solution tank is not needed. Thus, the processing solution tank for dipping, the large conveying path winding in the vertical direction, and the waste solution tank are not needed. Accordingly, the entire image forming apparatus can be structured simply and compactly.

In cases using processing solution which deteriorates severely when used, such as the processing solution mixture containing hydrogen peroxide, if the dipping method is used, all of the processing solution in the tank deteriorates rapidly merely by immersing the photosensitive material in the processing solution in the tank. As a result, the amount of the waste solution increases. However, in a case using a processing solution mixed with hydrogen peroxide so that each necessary amount thereof is applied on the photosensitive material by the processing solution applying means whereby each small amount thereof is used up, the deterioration of the processing solution does not spread to the entire processing solution during this processing. Therefore, the entire processing solution can be used effectively to the last.

Further, since the processing solution mixed with hydrogen peroxide is used as a developing intensifier, processing of the waste solution thereof does not harm the environment, as hydrogen peroxide separates into water and oxygen in the form of gas with time.

Next, a second embodiment of the image forming apparatus of the present invention will be described with reference to FIG. 12.

In the development-intensification processing section of the image forming apparatus according to the second embodiment, the first alkaline processing solution and the first solution including hydrogen peroxide, each of which is a processing solution, are applied on the photosensitive material by separate processing solution applying means. In the second embodiment, the cleaning section is disposed at a portion where the conveying path of the photosensitive material is set in a substantially vertical direction. Further, the stabilizing section and the drying section are disposed at a portion where the conveying path is set so that the emulsion surface of the photosensitive material moving on the conveying path is faced in a substantially vertically downward direction.

Figure 12:
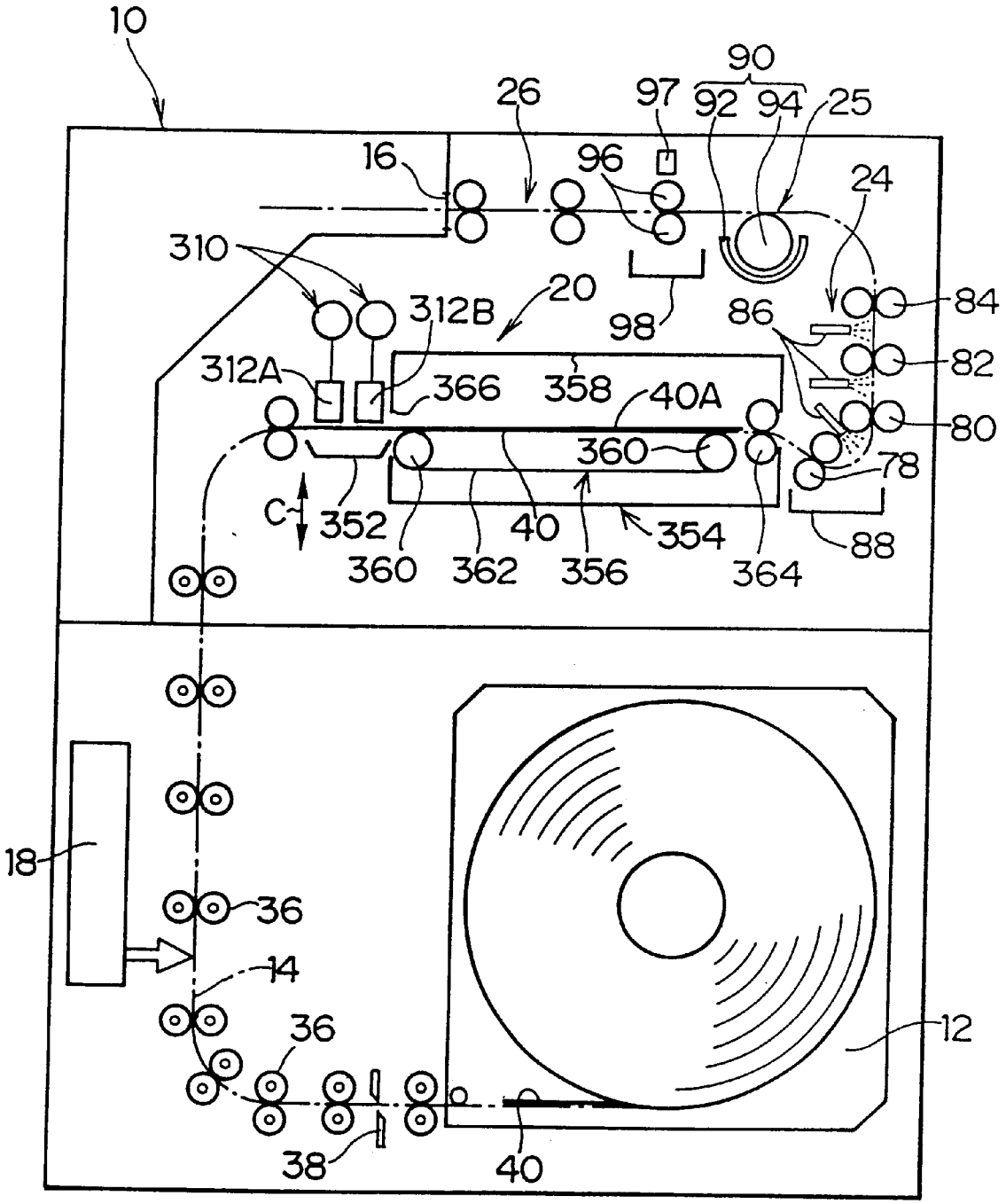
FIG. 12 is a front view showing a schematic structure of the entire image forming apparatus according to second and third embodiments of the present invention.

In the image forming apparatus shown in FIG. 12, the development-intensification processing section 20 disposed inside the apparatus body 10 comprises two processing solution applying means, i.e., applying devices 310, which are disposed side by side, and each of which is similar to the applying device illustrated in the previously described FIGS. 3–7.

A jetting tank 312A of the applying device 310 is disposed at a position more upstream the conveying path 14 than a jetting tank 312B, and applies the first alkaline processing solution only on the emulsion surface 40A, which is one side of the photosensitive material 40.

The jetting tank 312B of the applying device 310 is disposed at a position more downstream the conveying path 14 than the jetting tank 312A, and applies the first solution including hydrogen peroxide on the emulsion surface 40A immediately after the first alkaline processing solution has been applied thereon. On the emulsion surface 40A of the photosensitive material 40, the applied first solution including hydrogen peroxide is mixed with the first alkaline processing solution which has been applied thereon.

Further, each of the jetting tanks 312A and 312B of the applying devices 310 jets the respective processing solution from the nozzle holes 324 (shown in FIG. 4) which do not touch the emulsion surface 40A of the photosensitive material 40. This can prevent the first solution including hydrogen peroxide from deteriorating. The cause of such deterioration is that the chemical substance on the emulsion surface 40A flows in reverse into the nozzle holes 324 and mixes in the first solution including hydrogen peroxide stored in the jetting tank 312B of the applying device 310, and then chemical changes and the like are caused.

Therefore, the first solution including hydrogen peroxide, which is stored in the jetting tank 312B of the applying device 310 so as not to deteriorate, can be used up without wasting.

As shown in FIG. 12, at a position that faces the two sets of the jetting tanks 312A and 312B disposed side by side and is at the side of the conveying path 14 opposite thereto, the holding means is provided. The holding means is provided in order to prevent the nozzle holes 324 from clogging caused by evaporation of the water content of the processing solution and by deposition of components thereof at the respective nozzle holes 324 portion of the jetting tanks 312A and 312B, when the jetting tanks are not being used. Another reason for providing the holding means is in order to clean the nozzle holes 324 portions as needed by immersing the portions in the cleaning solution.

The holding means comprises the pan member 352 which has a substantially U-shaped cross-section and which can be operated to move in the direction of arrow C in FIG. 12. The pan member 352 is large enough to accommodate both of the two nozzle plate 322 portions (shown in FIGS. 4–7) of the two sets of the jetting tanks 312A and 312B disposed side by side, respectively.

When each of the jetting tanks 312A and 312B performs the operation of atomizing the processing solution, the pan member 352 is located at a position that is vertically downward from the conveying path 14 and is just below both of the nozzle holes 324 portions. In this case, the pan member 352 is used to catch the droplets of the processing solution which have been jetted from the nozzle holes 324 and have not been deposited on the photosensitive material 40.

For times when neither of the two sets of the jetting tanks 312A and 312B is being used, the pan member 352 is moved in the vertically upward direction and the respective nozzle holes 324 portion of each of the jetting tanks 312 is immersed in the solution stored to a predetermined level in the recessed portion of the pan member 352 so as to prevent the nozzle holes 324 portions from drying and causing clogging. Further, the recessed portion of the pan member 352 may be filled with the cleaning solution to perform cleaning of the nozzle holes 324 as needed.

On the emulsion surface 40A of the photosensitive material 40, the first alkaline processing solution and the first solution including hydrogen peroxide are separately deposited in a short time so as to be layered on each other by the jetting tanks 312A and 312B of the two sets of the applying devices 310 in the above-described manner. The photosensitive material 40 is then conveyed along the heat-control section 354 which is at a position along the conveying path 14 that is downstream with respect to the jetting tanks 312A and 312B of the applying devices 310 on the conveying path 14. During the conveyance, chemical changes are caused and the development-intensification processing is performed.

As shown in FIG. 12, the cleaning section 24 serving as the means for post-processing which is a step for ensuring preservation properties of the image formed on the photographic material 40, is disposed next to the development-intensification processing section 20 on the conveying path 14. The cleaning section 24 is disposed at a portion of the conveying path 14 at which the photosensitive material 40 is conveyed so as to extend in a substantially vertical direction. First conveying rollers 78 are provided immediately before a curving portion of the conveying path 14. At a vertical portion of the conveying path 14 which is at a position downstream with respect to the first conveying rollers 78, second, third, and fourth conveying rollers 80, 82 and 84 as three sets of conveying-and-squeezing rollers are disposed at equal intervals.

Further, a shower device 86 is disposed between the first and second conveying rollers 78 and 80, between the second and third conveying rollers 80 and 82, and between the third and fourth conveying rollers 82 and 84, respectively. Each of the shower devices 86 sprays the cleaning water only on the emulsion surface 40A to clean the emulsion surface 40A portion.

Part of the cleaning water, which has been sprayed on the emulsion surface 40A extending in the substantially vertical direction by each of the shower devices 86 in this manner, flows downward due to its own weight, and the flowed cleaning water is squeezed by the first, second or third conveying rollers 78, 80 or 82. The cleaning water deposited on the emulsion surface 40A is squeezed by the fourth conveying rollers 84. Then, the squeezed cleaning water flows into a pan 88, which is disposed vertically below the first, second, third and fourth conveying rollers 78, 80, 82 and 84. The cleaning water is thus recovered in the pan 88.

When the cleaning water is sprayed on the emulsion surface of the photosensitive material 40 extending in the vertical direction, the sprayed cleaning water tends to flow in the vertically downward direction of the emulsion surface 40A. This can prevent the cleaning water from flowing toward the side surface opposite to the emulsion surface 40A of the photosensitive material 40. Thus, the operation of cleaning can be performed to clean only the emulsion surface 40A of the photosensitive material 40, keeping the opposite surface dry.

As shown in FIG. 12, the stabilizing section 25 is disposed at a position downstream with respect to the cleaning section 24 on the conveying path 14. The stabilizing section 25 is disposed at a portion of the conveying path at which the photosensitive material 40 is conveyed in a substantially horizontal direction in a state in which the emulsion surface 40A thereof faces the vertically downward direction.

In other words, as shown in FIG. 12, the portion extending from the development-intensification processing section 20 through the cleaning section 24 and the stabilizing section 25 to the drying section 26 of the conveying path 14 is set in a U-shape. The stabilizing section 25 is disposed at a portion of the conveying path 14, which portion is set at the upper side in the substantially horizontal direction.

At the stabilizing section 25, which serves as a means for post-processing which is a step for ensuring preservation properties of the image formed on the photosensitive material 40, a roller bead 90 for applying the first stabilizing solution on the emulsion surface 40A is disposed. The roller bead 90 comprises a roller 94 immersed halfway into the first stabilizing solution in a stabilizing solution tank 92. A suitable amount of the first stabilizing solution is applied on the emulsion surface 40A, by rotating the roller 94 on the emulsion surface 40A, which corresponds to the down-faced side of the photosensitive material 40 conveyed on the conveying path 14.

If the first stabilizing solution is applied on the down-faced emulsion surface 40A of the photosensitive material 40 by the roller bead 90 in this manner, the first stabilizing solution deposited on the emulsion surface 40A does not resist gravity to move onto the upper side surface of the photosensitive material 40 and thus does not wet the upper side surface. In this way, the first stabilizing solution can be applied only on the emulsion surface 40A.

At a portion adjacent to the roller bead 90 in the downstream direction on the conveying path 14, a pair of rollers 96 are disposed, which rotate on the photosensitive material 40 while nipping the photosensitive material 40 therebetween so as to squeeze off the processing solution. Above the rollers 96, a cleaning section 97 is provided. The cleaning section 97 is for cleaning the rollers 96 by causing cleaning solution to drip down from external peripheral surfaces thereof. Further, a pan 98 is disposed vertically below the rollers 96. The pan 98 catches spent cleaning solution dripping from the rollers 96 and recovers the dripped cleaning solution.

At the portion extending from the rollers 96 to the outlet 16 on the conveying path 14, the drying section 26 is provided.

In the image forming apparatus of the second embodiment, the structure, operation and effect other than those described above are the same as those of the previously described first embodiment. Accordingly, the same members are given the same reference numerals, and detailed descriptions thereof are omitted.

Next, the photosensitive material 40 used in the image forming apparatus of the second embodiment each of the processing solutions will be described.

The photosensitive material 40 used in the image forming apparatus is the same as that used in the previously described first embodiment.

Each of the processing solutions used in the image forming apparatus is described below.

Subsequently, when a command for forming the image of the original document on the photosensitive material 40 is input to the controlling section (not shown) of the apparatus body 10, the paper feeding section 12 is operated by the command of the controlling section, and the band-shaped photosensitive material 40 is fed onto the conveying path 14. The photosensitive material 40, which has been fed a predetermined length onto the conveying path 14 in this manner, is cut into a predetermined size by the cutter 38, and is then conveyed to the exposing section 18.

At the exposing section 18, the emulsion surface 40A which is one side of the photosensitive material 40 is exposed in accordance with an image-processed data to form a latent image which corresponds to the image on the original document, and then the photosensitive material 40 is conveyed to the development-intensification processing section 20. At the development-intensification processing section 20, the first alkaline processing solution is applied on (First alkaline processing solution)

| | |
|---|---|
| water | 800 ml |
| soduim 5-sulfosalicylate | 50 g |
| KCl | 2.5 g |
| benzotriazole | 0.02 g |
| hydroxyethylidene-1,1-diphosphonic acid (30% aqueous solution) | 4 ml |
| surfactant (compound represented by the following Stil-1) | 5 g |
| Further, water was added to the above such that the total amount of the solution was 1 liter | |
| pH | 13 |

Stil-1

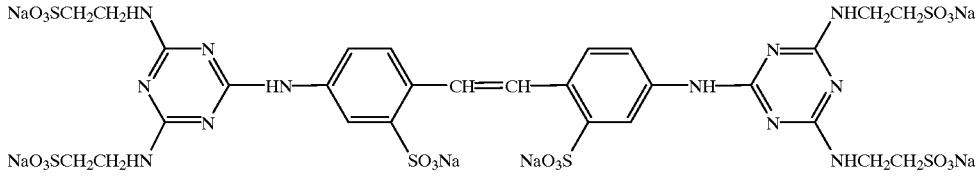

(First solution uncluding hydrogen peroxide)

| | |
|---|---|
| water | 800 ml |
| hydrogen peroxide (30% aqueous solution) | 30 ml |
| surfactant (Stil-1) | 5 g |
| Further, water was added to the above such that the total amount of the solution was 1 liter | |
| pH | 5.8 |

(First stabilizing solution)

| | |
|---|---|
| potassium carbonate | 15 g |
| soduim 2-mercaptobenzimidazole-5-sulfonate | 1 g |
| hydroxyethylidene-1,1-diphosphonic acid (30% aqueous solution) | 1 ml |
| 5-chloro-2-methyl-4-isothiazoline-3-one | 0.02 g |
| Further, water was added to the above such that the total amount of the solution was 1 liter | |
| pH | 7.0 |

Next, the operation and the method of using the image forming apparatus, wherein the apparatus is structured in the above-described manner and is of the second embodiment, will be explained with reference to FIG. 12. Initially, image signals for an original document with an image are input by using the scanner or the like, and are subjected to the image processing, so as to prepare the exposing section 18 for operation.

the emulsion surface 40A of the photosensitive material 40 by the jetting tank 312A of the applying device 310 serving as the processing solution applying means, under conditions in which the quantity for application is 40 cc/m$^2$, the width of the nozzle is 5.5 cm, and the length for application is 12 cm.

Further, immediately after applying the first alkaline processing solution, the first solution including hydrogen peroxide is applied on the emulsion surface 40A of the photosensitive material 40 by the jetting tank 312B so as to be layered onto the first alkaline processing solution, under conditions in which the quantity for application is 40 cc/m$^2$, the width of the nozzle is 5.5 cm, and the length for application is 12 cm.

The photosensitive material 40 is subjected to the processing for 30 seconds during which the photosensitive material 40 is conveyed on the conveying path 14 at a predetermined temperature (40° C.). Thereafter, the excess processing solution thereon is squeezed off by the rollers 364, and then the photosensitive material 40 is conveyed to the cleaning section 24.

At the cleaning section 24, which is the means for post-processing which is a step for ensuring preservation properties of the image formed on the photosensitive material 40, the cleaning water (30° C.) is splashed on the emulsion surface 40A of the photosensitive material 40 by the shower devices 86, the photosensitive material 40 is rinsed for 90 seconds, and the residual cleaning water deposited on the photosensitive material 40 is squeezed off by the squeezing rollers 84. Next, the photosensitive material 40 is conveyed to the stabilizing section 25.

At the stabilizing section 25, which is the means for post-processing which is a step for ensuring preservation properties of the image formed on the photosensitive material 40, the first stabilizing solution (40° C.) is applied on the emulsion surface 40A of the photosensitive material 40 by the roller bead 90, and the photosensitive material 40 is subjected to the stabilizing processing for 45 seconds. Next, the photosensitive material 40 is conveyed to the drying section 26.

At the drying section 26, primarily the emulsion surface 40A of the photosensitive material 40 wetted with the processing solution is dried for 10 seconds during which the photosensitive material 40 is conveyed 140 mm on the conveying path 14, and then the photosensitive material 40 is conveyed from the outlet 16 onto the tray as a finished product on which the image has been formed. As a result, a series of controlling operations for the image forming processing is completed.

The processing in each of the above-described operation processes is performed only for the emulsion surface 40A. Accordingly, compared with the case in which both the emulsion surface 40A of the photosensitive material 40 and the surface opposite to the emulsion surface 40A are wetted in the same manner, such as in a conventional so-called dipping method or the like, the amount of the processing solution to be applied can be reduced and the deterioration of the entire processing solution can be decreased. This is because each processing solution needs to be applied and the cleaning and stabilizing processings need to be performed only on the emulsion surface 40A which is one side of the photosensitive material 40. Further, compared with the case in which the entirety of the two surfaces of the photosensitive material 40 are dried in the same manner, the time for drying can be shortened and thus the time for processing can be shortened considerably, because the emulsion surface 40A side of the photosensitive material 40 is primarily required to be dried.

Plural series of routes, in which the previously described processing operations such as exposing, developing, cleaning, drying and the like are performed, may be provided in the image forming apparatus.

In the structure of the present second embodiment, the conventional so-called dipping method is not used in the image forming apparatus. Accordingly, a large-sized processing solution tank for dipping the photosensitive material is not needed.

Further, in the structure of the second embodiment, the processing solution is used up, and waste solution does not remain. Accordingly, a large-sized waste solution tank is not needed. Thus, the entire image forming apparatus can be structured simply and compactly.

Next, a third embodiment of the image forming apparatus of the present invention will be explained, with reference to FIG. 12.

In the development-intensification processing section of the image forming apparatus according to the present third embodiment, the second alkaline processing solution and the second solution including hydrogen peroxide in the above-described second example of the first embodiment, are each applied onto the photosensitive material with separate processing solution applying means.

In the image forming apparatus shown in FIG. 12, the development-intensification processing section 20 disposed inside the apparatus body 10 comprises two processing solution applying means, i.e., the applying devices 310, which are disposed side by side, each of which is similar to the applying device illustrated in the previously described FIGS. 3–7.

The jetting tank 312A of the applying device 310 is disposed at a position more upstream the conveying path 14 than the jetting tank 312B, and applies the second alkaline processing solution only on the emulsion surface 40A, which is one side of the photosensitive material 40.

The jetting tank 312B of the applying device 310 applies the second solution including hydrogen peroxide on the emulsion surface 40A immediately after the first alkaline processing solution has been applied thereon. Accordingly, on the emulsion surface 40A of the photosensitive material 40, the applied second solution including hydrogen peroxide is mixed with the second alkaline processing solution which has been applied thereon.

The jetting tanks 312A and 312B are non-contacting type applying means. Each of the jetting tanks 312A and 312B of the applying devices 310 jets the respective processing solution from the nozzle holes 324 (shown in FIG. 4) which do not touch the emulsion surface 40A of the photosensitive material 40. This can prevent the second solution including hydrogen peroxide from deteriorating. The cause of such deterioration is that the chemical substance on the emulsion surface 40A flows in reverse into the nozzle holes 324 and mixes in the second solution including hydrogen peroxide stored in the jetting tank 312B of the applying device 310, and then chemical changes and the like are caused.

Therefore, the second solution including hydrogen peroxide, which is stored in the jetting tank 312B of the applying device 310 so as not to deteriorate, can be used up without wasting.

On the emulsion surface 40A of the photosensitive material 40, the second alkaline processing solution and the second solution including hydrogen peroxide are separately deposited in a short time so as to be layered on each other by the jetting tanks 312A and 312B of the two applying devices 310 in the above-described manner. The photosensitive material 40 is then conveyed along the heat-control section 354 which is at a position along the conveying path 14 that is downstream with respect to the jetting tanks 312A and 312B of the applying devices 310 on the conveying path 14. During the conveyance, chemical changes are caused and the development-intensification processing is performed.

As shown in FIG. 12, the cleaning section 24 serving as the means for post-processing which is a step for ensuring preservation properties of the image formed on the photographic material 40, is disposed next to the development-intensification processing section 20 on the conveying path 14. The cleaning section 24 is disposed at a portion of the conveying path 14 at which the photosensitive material 40 is conveyed so as to extend in a substantially vertical direction. First conveying rollers 78 are provided immediately before a curving portion of the conveying path 14. At a vertical portion of the conveying path 14 which is at a position downstream with respect to the first conveying rollers 78, second, third, and fourth conveying rollers 80, 82 and 84 as three sets of conveying-and-squeezing rollers are disposed at equal intervals.

Further, shower devices 86 are disposed between the first and second conveying rollers 78 and 80, between the second and third conveying rollers 80 and 82, and between the third and fourth conveying rollers 82 and 84, respectively. Each of the shower devices 86 sprays the cleaning water only on the emulsion surface 40A to clean the emulsion surface 40A portion.

When the cleaning water is sprayed on the emulsion surface of the photosensitive material 40 extending in the vertical direction, the sprayed cleaning water tends to flow in the vertically downward direction of the emulsion surface 40A. This can prevent the cleaning water from flowing toward the side surface opposite to the emulsion surface 40A of the photosensitive material 40. Thus, the operation of cleaning can be performed to clean only the emulsion surface 40A of the photosensitive material 40, keeping the opposite surface dry.

As shown in FIG. 12, the stabilizing section 25 is disposed at a position downstream with respect to the cleaning section 24 on the conveying path 14. The stabilizing section 25 is disposed at a portion of the conveying path at which the photosensitive material 40 is conveyed in a substantially horizontal direction in a state in which the emulsion surface 40A thereof faces the vertically downward direction.

At the stabilizing section 25, the roller bead 90 for applying the second stabilizing solution on the emulsion surface 40A is disposed. The roller bead 90 comprises the roller 94 immersed halfway into the second stabilizing solution in the stabilizing solution tank 92. A suitable amount of the second stabilizing solution is applied on the emulsion surface 40A, by rotating the roller 94 on the emulsion surface 40A, which corresponds to the down-faced side of the photosensitive material 40 conveyed on the conveying path 14.

If the second stabilizing solution is applied on the down-faced emulsion surface 40A of the photosensitive material 40 by the roller bead 90 in this manner, the second stabilizing solution deposited on the emulsion surface 40A does not resist gravity to move onto the upper side surface of the photosensitive material 40 and thus does not wet the upper side surface. In this way, the second stabilizing solution can be applied only on the emulsion surface 40A. Further, instead of the roller bead 90, another non-contacting processing solution applying means using the jetting tank 312 of the applying device 320 or the like may be used.

At a portion adjacent to the roller bead 90 in the downstream direction on the conveying path 14, the pair of rollers 96 are disposed, which rotate on the photosensitive material 40 while nipping the photosensitive material 40 therebetween so as to squeeze off the post-processing solution. Above the rollers 96, the cleaning section 97 is provided. The cleaning section 97 is for cleaning the rollers 96 by causing the cleaning solution to drip down from external peripheral surfaces thereof. Further, the pan 98 is disposed vertically below the rollers 96. The pan 98 catches spent cleaning solution dripping from the rollers 96 and recovers the dripped cleaning solution.

At the portion extending from the rollers 96 to the outlet 16 on the conveying path 14, the drying section 26 is provided.

In the image forming apparatus of the third embodiment, the structure, operation and effect other than those described above are the same as those of the previously described second embodiment. Accordingly, the same members are given the same reference numerals, and detailed descriptions thereof are omitted.

Next, a fourth embodiment of the image forming apparatus of the present invention will be described with reference to FIG. 13.

In the development-intensification processing section 20 of the image forming apparatus according to the present fourth embodiment, the first alkaline processing solution and the first solution including hydrogen peroxide, each of which is in the above-described second embodiment, are each applied onto the photosensitive material with separate processing solution applying means. In addition, the fourth embodiment is structured by disposing on the conveying path for the photosensitive material the development-intensification processing section 20, followed by the stabilizing section 25 and the cleaning section 24. The stabilizing section 25 serves as the means for post-processing which is a step for ensuring preservation properties of the image formed on the photosensitive material 40.

Figure 13:
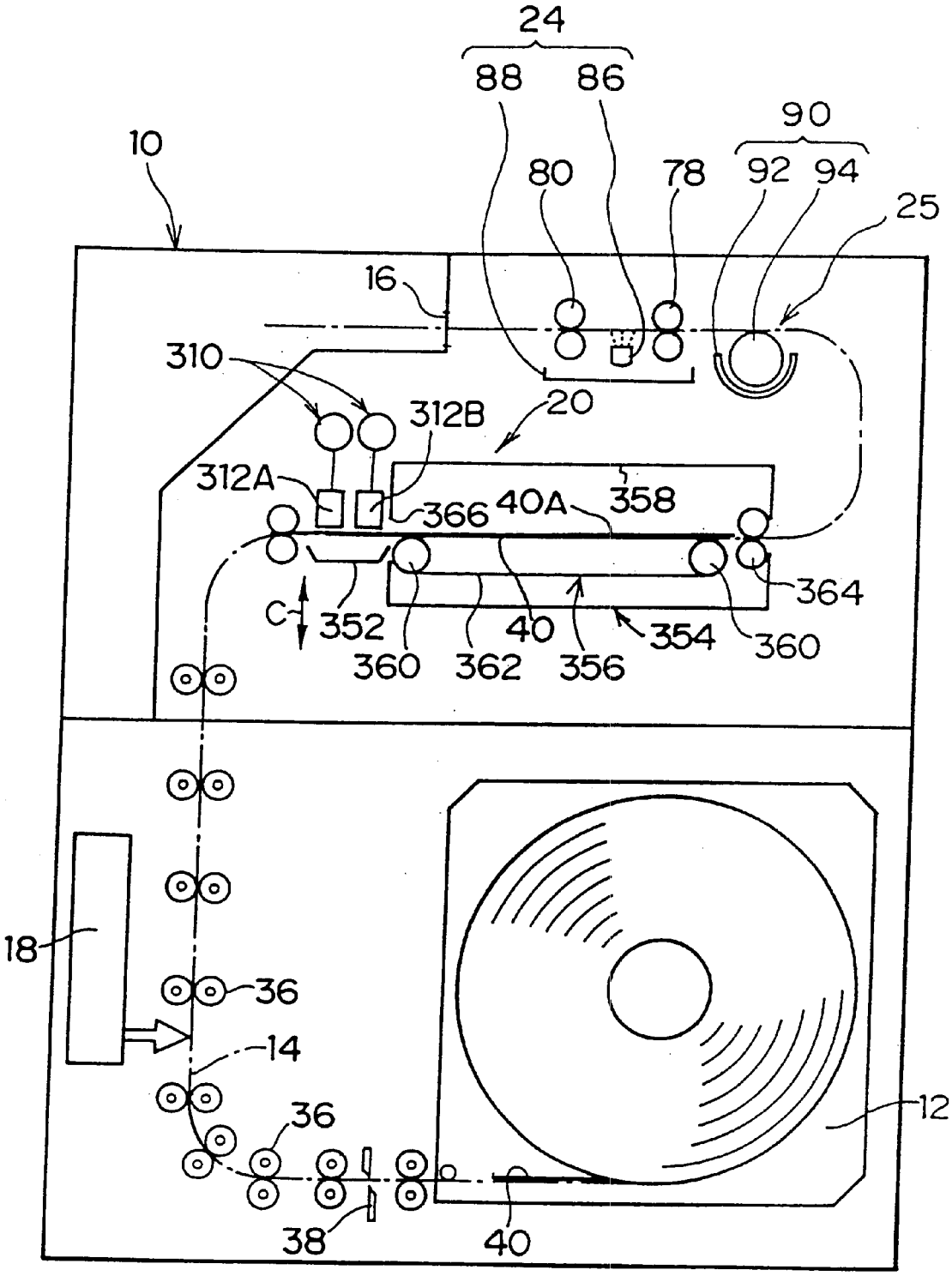
FIG. 13 is a front view showing a schematic structure of the entire image forming apparatus according to a fourth embodiment of the present invention.

In the image forming apparatus shown in FIG. 13, the development-intensification processing section 20 disposed inside the apparatus body 10 comprises two processing solution applying means, i.e., the applying devices 310, which are disposed side by side, each of which is similar to the applying device illustrated in the previously described FIGS. 3–7.

The jetting tank 312A of the applying device 310 is disposed at a position more upstream the conveying path 14 than the jetting tank 312B, and applies the first alkaline processing solution only on the emulsion surface 40A, which is one side of the photosensitive material 40.

The jetting tank 312B of the applying device 310 applies the first solution including hydrogen peroxide on the emulsion surface 40A immediately after the first alkaline processing solution has been applied thereon. Accordingly, on the emulsion surface 40A of the photosensitive material 40, the applied first solution including hydrogen peroxide is mixed with the first alkaline processing solution which has been applied thereon. Each of the jetting tanks 312A and 312B of the applying devices 310 jets the respective processing solution from the nozzle holes 324 (shown in FIG. 4) which do not touch the emulsion surface 40A of the photosensitive material 40. This can prevent the first solution including hydrogen peroxide from deteriorating. The cause of such deterioration is that the chemical substance on the emulsion surface 40A flows in reverse into the nozzle holes 324 and mixes in the first solution including hydrogen peroxide stored in the jetting tank 312B of the applying device 310, and then chemical changes and the like are caused.

Therefore, the first solution including hydrogen peroxide, which is stored in the jetting tank 312B of the applying device 310 so as not to deteriorate, can be used up without wasting.

On the emulsion surface 40A of the photosensitive material 40, the first alkaline processing solution and the first solution including hydrogen peroxide are separately deposited in a short time so as to be layered on each other by the jetting tanks 312A and 312B of the two applying devices 310 in the above-described manner. The photosensitive material 40 is then conveyed along the heat-control section 354 which is at a position along the conveying path 14 that is downstream with respect to the jetting tanks 312A and 312B of the applying devices 310 on the conveying path 14. During the conveyance, chemical changes are caused and the development-intensification processing is performed.

As shown in FIG. 13, the stabilizing section 25 serving as the means for post-processing which is a step for ensuring preservation properties of the image formed on the photographic material 40, is disposed next to the development-intensification processing section 20 on the conveying path 14. The stabilizing section 25 is disposed at a portion of the conveying path 14 at which the photosensitive material 40 is conveyed so as to extend in a substantially horizontal direction while the emulsion surface 40A faces downward in the vertical direction.

As shown in FIG. 13, the conveying path 14 is set in a u-shaped form, from the development-intensification processing section 20, the stabilizing section 25 and to the cleaning section 24. The stabilizing section 25 is disposed at a portion at the beginning of the conveying path 14 at the upper side (of FIG. 13), which is set in the substantially horizontal direction.

At the stabilizing section 25, the roller bead 90 for applying the first stabilizing solution on the emulsion surface 40A is disposed. The roller bead 90 comprises the roller 94 immersed halfway into the first stabilizing solution in the stabilizing solution tank 92. A suitable amount of the first stabilizing solution is applied on the emulsion surface 40A, by rotating the roller 94 on the emulsion surface 40A, which corresponds to the down-faced side of the photosensitive material 40 conveyed on the conveying path 14.

If the first stabilizing solution is applied on the down-faced emulsion surface 40A of the photosensitive material 40 by the roller bead 90 in this manner, the first stabilizing solution deposited on the emulsion surface 40A does not resist gravity to move onto the upper side surface of the photosensitive material 40 and thus does not wet the upper side surface. In this way, the first stabilizing solution can be applied only on the emulsion surface 40A.

The cleaning section 24 is disposed after the stabilizing section 25 at the conveying path 14. As illustrated in FIG. 13, the cleaning section 24 is disposed at a portion at which the photosensitive material 40 on the conveying path 14 is conveyed so as to extend in the substantially horizontal direction, with the emulsion surface 40A thereof facing downward in the vertical direction. The cleaning section 24 is another portion of the means for post-processing, which is a step for ensuring preservation properties of an image formed on the photosensitive material 40.

Accordingly, the second conveying rollers 80 are disposed at a portion at which the conveying path 14 conveys the photosensitive material in a substantially horizontal direction, downstream from the first conveying rollers 78, which are near the stabilizing section 25. A predetermined distance is left between the second conveying rollers 80 and the first conveying rollers 78.

Further, the shower device 86 as non-contacting type applying means is disposed between the first and second conveying rollers 78 and 80. The shower device 86 sprays the cleaning water only on the emulsion surface 40A, which is one side of the photosensitive material 40 conveyed in the horizontal direction. The shower device 86 thereby cleans the emulsion surface 40A portion. A pan 88 collects the spent cleaning solution.

When the cleaning water is sprayed on the emulsion surface of the photosensitive material 40 facing downward in the vertical direction, the cleaning water deposited on the emulsion surface 40A does not resist gravity to move onto the upper side surface of the photosensitive material 40 and thus does not wet the upper side surface. Thus, the operation of cleaning can be performed to clean only the emulsion surface 40A of the photosensitive material 40, keeping the opposite surface dry.

In the image forming apparatus of the fourth embodiment, the structure, operation and effect other than those described above are the same as those of the previously described second embodiment. Accordingly, the same members are given the same reference numerals, and detailed descriptions thereof are omitted.

Next, a fifth embodiment of the image forming apparatus of the present invention will be explained, with reference to FIG. 14.

In the development-intensification processing section of the image forming apparatus according to the present fifth embodiment, the second alkaline processing solution and the second solution including hydrogen peroxide in the above-described second example of the first embodiment, are each applied onto the photosensitive material with separate processing solution applying means. In addition, the fifth embodiment is structured by disposing a stabilizing section and a drying section at a portion of the conveying path set so that the emulsion surface of the photosensitive material faces substantially downward in the vertical direction. The stabilizing section serves as the means for post-processing which is a step for ensuring preservation properties of the image formed on the photosensitive material 40. The image forming apparatus of the present fifth embodiment has no cleaning section.

Figure 14:
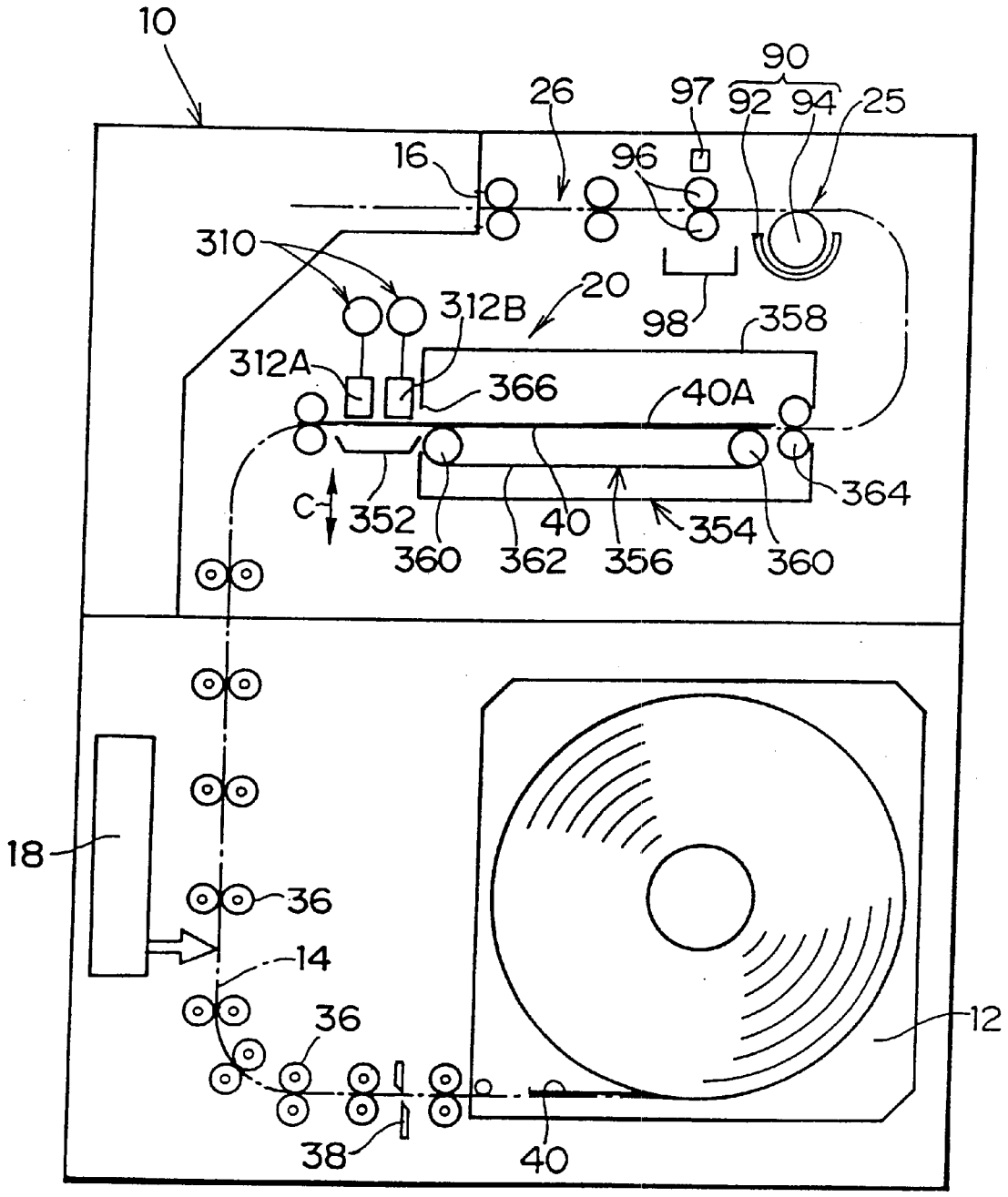
FIG. 14 is a front view showing a schematic structure of the entire image forming apparatus according to a fifth embodiment of the present invention.

In the image forming apparatus shown in FIG. 14, the development-intensification processing section 20 disposed inside the apparatus body 10 comprises two processing solution applying means, i.e., the applying devices 310, which are disposed side by side, each of which is similar to the applying device illustrated in the previously described FIGS. 3–7.

The jetting tank 312A of the applying device 310 is disposed at a position more upstream the conveying path 14 than the jetting tank 312B, and applies the second alkaline processing solution only on the emulsion surface 40A, which is one side of the photosensitive material 40.

The jetting tank 312B of the applying device 310 applies the second solution including hydrogen peroxide on the emulsion surface 40A immediately after the second alkaline processing solution has been applied thereon. Accordingly, on the emulsion surface 40A of the photosensitive material 40, the applied second solution including hydrogen peroxide is mixed with the second alkaline processing solution which has been applied thereon.

Each of the jetting tanks 312A and 312B of the applying devices 310 jets the respective processing solution from the nozzle holes 324 (shown in FIG. 4) which do not touch the emulsion surface 40A of the photosensitive material 40. This can prevent the second solution including hydrogen peroxide from deteriorating. The cause of such deterioration is that the chemical substance on the emulsion surface 40A flows in reverse into the nozzle holes 324 and mixes in the second solution including hydrogen peroxide stored in the jetting tank 312B of the applying device 310, and then chemical changes and the like are caused.

Therefore, the second solution including hydrogen peroxide, which is stored in the jetting tank 312B of the applying device 310 so as not to deteriorate, can be used up without wasting.

On the emulsion surface 40A of the photosensitive material 40, the second alkaline processing solution and the second solution including hydrogen peroxide are separately deposited in a short time so as to be layered on each other by the jetting tanks 312A and 312B of the two applying devices 310 in the above-described manner. The photosensitive material 40 is then conveyed along the heat-control section 354 which is at a position along the conveying path 14 that is downstream with respect to the jetting tanks 312A and 312B of the applying devices 310 on the conveying path 14. During the conveyance, chemical changes are caused and the development-intensification processing is performed.

As shown in FIG. 14, the stabilizing section 25 is disposed at a position downstream with respect to the development-intensification processing section 20 on the conveying path 14. The stabilizing section 25 is disposed at a portion of the conveying path at which the photosensitive material 40 is conveyed in a substantially horizontal direction in a state in which the emulsion surface 40A thereof faces the vertically downward direction. The stabilizing section 25 is the means for post-processing which is a step for ensuring preservation properties of an image formed on the photosensitive material 40.

As shown in FIG. 14, the conveying path 14 is set in a u-shaped form, from the development-intensification processing section 20, the stabilizing section 25, and to the drying section 26. The stabilizing section 25 is disposed at a portion at the beginning of the conveying path 14 at the upper side (of FIG. 14), which is set in the substantially horizontal direction.

At the stabilizing section 25, the roller bead 90 for applying the second stabilizing solution on the emulsion surface 40A is disposed, which second stabilizing solution is a post-processing solution and is described in the second example of the first embodiment. The roller bead 90 comprises the roller 94 immersed halfway into the second stabilizing solution in the stabilizing solution tank 92. A suitable amount of the second stabilizing solution is applied on the emulsion surface 40A, by rotating the roller 94 on the emulsion surface 40A, which corresponds to the down-faced side of the photosensitive material 40 conveyed on the conveying path 14.

If the second stabilizing solution is applied on the down-faced emulsion surface 40A of the photosensitive material 40 by the roller bead 90 in this manner, the second stabilizing solution deposited on the emulsion surface 40A does not resist gravity to move onto the upper side surface of the photosensitive material 40 and thus does not wet the upper side surface. In this way, the second stabilizing solution can be applied only on the emulsion surface 40A.

At a portion adjacent to the roller bead 90 in the downstream direction on the conveying path 14, the pair of rollers 96 are disposed, which rotate on the photosensitive material 40 while nipping the photosensitive material 40 therebetween so as to squeeze off the post-processing solution. Above the rollers 96, the cleaning section 97 is provided. The cleaning section 97 is for cleaning the rollers 96 by causing the cleaning solution to drip down from external peripheral surfaces thereof. Further, the pan 98 is disposed vertically below the rollers 96. The pan 98 catches spent cleaning solution dripping from the rollers 96 and recovers the dripped cleaning solution.

At the portion extending from the rollers 96 to the outlet 16 on the conveying path 14, the drying section 26 is provided.

In the image forming apparatus of the fifth embodiment, the structure and effect other than those described above are the same as those of the previously described second embodiment. Accordingly, the same members are given the same reference numerals, and detailed descriptions thereof are omitted.

Further, in the image forming apparatus of the present fifth embodiment, the photosensitive material 40, and each of the processing solutions and post-processing solutions are equivalent to those described in the second example of the first embodiment.

Next, a description will be provided of operation and method of use of the image forming apparatus relating to the fifth embodiment structured as described above, with reference to FIG. 14.

First, image signals of an original are input by using the scanner of the like, and are subjected to the image processing, so as to prepare the exposing section 18 for operation.

Subsequently, when a command for forming the image of the original document on the photosensitive material 40 is input to the controlling section (not shown) of the apparatus body 10, the paper feeding section 12 is operated by the command of the controlling section, and the band-shaped photosensitive material 40 is fed onto the conveying path 14. The photosensitive material 40, which has been fed a predetermined length onto the conveying path in this matter, is cut into a predetermined size by the cutter 38, and is then conveyed to the exposing section 18.

At the exposing section 18, the emulsion surface 40A, which is one side of the photosensitive material 40, is exposed in accordance with an image processed-data to form a latent image which corresponds to the image on the original document. The photosensitive material 40 is then conveyed to the development-intensification processing section 20. At the development-intensification processing section 20, the second alkaline processing solution (alkaline activator solution) at a predetermined temperature (approximately of from 35 to 45° C.) is applied onto the emulsion surface 40A of the photosensitive material 40. The second alkaline solution is applied with the applying device 310 serving as the processing solution applying means.

The conditions for application at this time are as follows: the quantity of the second alkaline processing solution applied is 20 cc/m$^2$, the pitch P between the nozzle holes is $(\sqrt{3})\cdot D/2$ or less =150 $\mu$m, the width of the nozzle (the width from one end to the other of the plurality of nozzle holes of the jetting tank 312, in the direction intersecting the direction the photosensitive material 40 is moved) is 5.5 cm, and the length for application (the length of the second alkaline processing solution applied as the photosensitive material is moved beneath the nozzle) is 12 cm.

Further, immediately after the second alkaline processing solution is applied, the second solution including hydrogen peroxide is layered by the jetting tank 312B, onto the second alkaline processing solution on the emulsion surface 40A of the photosensitive material 40. The conditions for application at this time are as follows: the quantity of the second solution including hydrogen peroxide applied is 20 cc/m$^2$, the pitch P between the nozzle holes is $(\sqrt{3})\cdot D/2$ or less=150 $\mu$m, the width of the nozzle is 5.5 cm, and the length for application is 12 cm.

The photosensitive material 40 is then subjected to the developing processing for 18 seconds, during which the photosensitive material 40 is conveyed on the conveying path 14, which is on the heat panel. The heat panel is means for adjusting heating temperature of the development-intensification processing section 20, and adjusts the temperature to approximately 40° C. Next, the photosensitive material 40 is conveyed to the stabilizing section 25.

At the stabilizing section 25, the second stabilizing solution adjusted to a solution temperature of between 35 to 45° C. is deposited onto the emulsion surface 40A of the photosensitive material 40 to carry out stabilizing processing. The second stabilizing solution is deposited with the roller bead 90. Thereafter, the photosensitive material 40 is conveyed to the drying section 26.

At the drying section 26, the emulsion surface 40A of the photosensitive material 40 wetted with the post-processing solution is dried during the 10 seconds that the photosensitive material 40 is conveyed on the conveying path 14, in an atmosphere adjusted to a temperature of between 60 to 100° C. The photosensitive material 40 is then conveyed from the outlet 16 onto the tray as a finished product on which the image has been formed. As a result, a series of controlling operations for the image forming processing is completed.

The processing in each of the above-described operation processes is performed only for the emulsion surface 40A which is one side of the photosensitive material 40. Accordingly, compared with the case in which both the emulsion surface 40A of the photosensitive material 40 and the surface opposite to the emulsion surface 40A are wetted in the same manner, such as in a conventional so-called dipping method or the like, the amount of the processing solutions and the post-processing solutions to be applied can be reduced and the deterioration of the processing solutions and the post-processing solutions as a whole can be decreased. Further, compared with the case in which the entirety of the two surfaces of the photosensitive material 40 are dried in the same manner, the time for drying can be shortened and thus the time for processing can be shortened considerably, because the emulsion surface 40A side of the photosensitive material 40 is primarily required to be dried.

Plural series of routes, in which the previously described processing operations such as exposing, developing, drying and the like are performed, may be provided in the image forming apparatus.

In the present fifth embodiment, by carrying out post-processing in which the acidic second stabilizing solution is applied, residual silver on the emulsion surface 40A of the photosensitive material 40 forms a complex compound, thus effecting stabilization. Simultaneously, citric acid in the second stabilizing solution neutralizes the alkaline component which is applied on the emulsion surface 40A by applying the second alkaline processing solution thereon, in a prior step. As a result, the preservation properties of an image formed on the photosensitive material 40 are ensured.

Accordingly, one of the processing steps, i.e., cleaning off the alkaline components of the photosensitive material 40, may be omitted from among all of the processing steps for forming an image with the image forming apparatus. Thus, the structure of the image forming apparatus can be simplified correspondingly to the omission of one of the processing steps and the image forming apparatus can be manufactured at reduced cost.

Next, a sixth embodiment of the image forming apparatus of the present invention will be explained, with reference to FIG. 15.

In the development-intensification processing section 20 of the image forming apparatus according to the present sixth embodiment, the second alkaline processing solution and the second solution including hydrogen peroxide described in the second example of the first embodiment, are each applied onto the photosensitive material with separate processing solution applying means. The image forming apparatus of the present sixth embodiment does not include a cleaning section.

Figure 15:
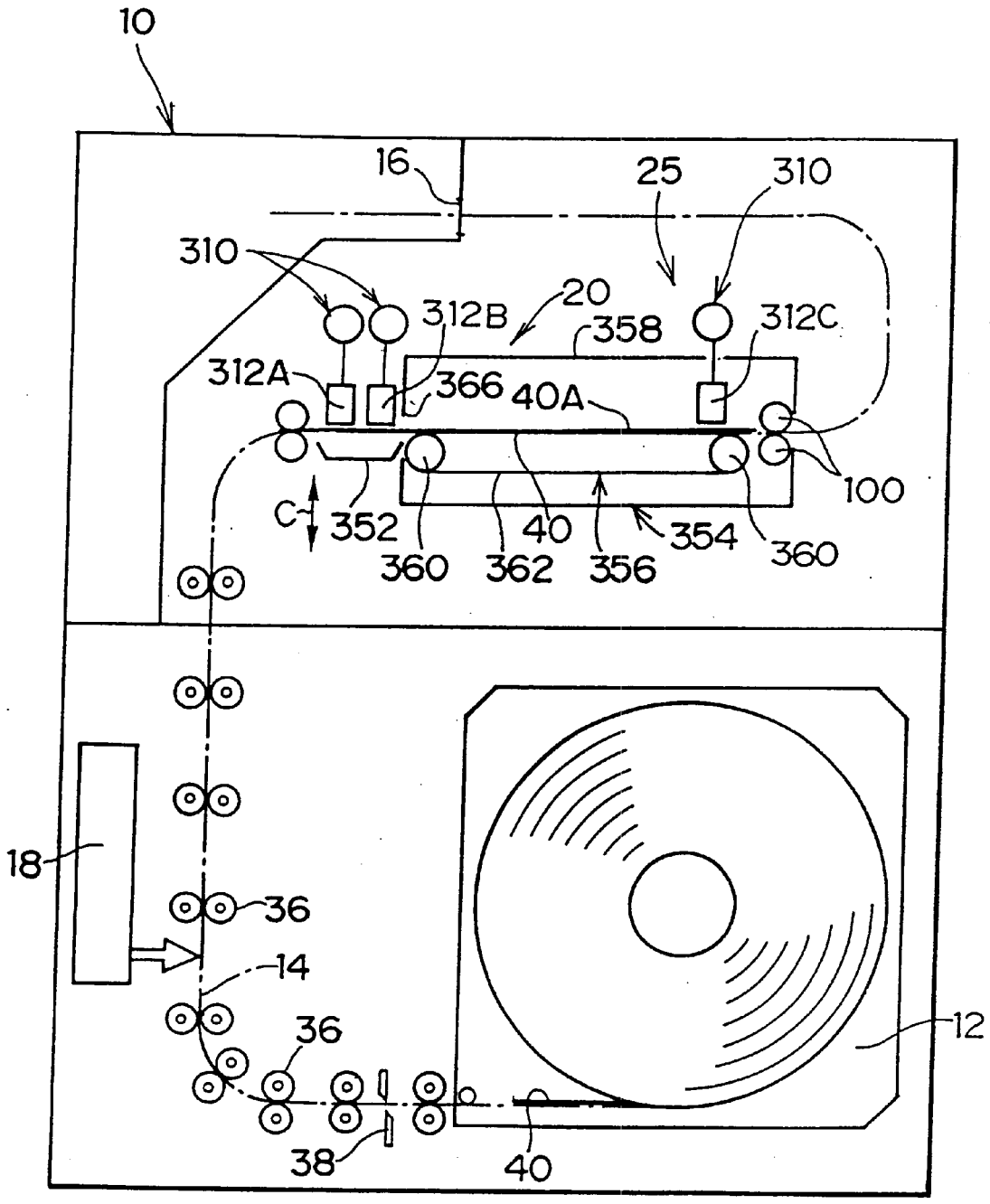
FIG. 15 is a front view showing a schematic structure of the entire image forming apparatus according to a sixth embodiment of the present invention.

In the image forming apparatus shown in FIG. 15. three processing solution applying means total are comprised between the development-intensification processing section 20, which is disposed inside the apparatus body 10, and the stabilizing section 25. The stabilizing section 25 serves as the means for post-processing, which is a step for ensuring preservation properties of an image formed on the photosensitive material 40. The development-intensification processing section 20 may comprise two processing solution applying means, i.e., the applying devices 310, which are disposed side by side, each of which is non-contacting type applying means similar to that illustrated in the previously described FIGS. 3–7. The processing solution applying means of the stabilizing section 25 is structured by disposing an applying device 310, which is non-contacting type applying means similar to that illustrated in the previously described FIGS. 3 to 7, at a position separated a predetermined distance from the two applying devices 310 serving as processing solution applying means of the development-intensification processing section 20.

The jetting tank 312A of the applying device 310 is disposed at a position furthest upstream the conveying path 14, among the jetting tank 312A, the jetting tank 312B, and a jetting tank 312C of the three applying devices 310, respectively. The jetting tank 312A applies the second alkaline processing solution only on the emulsion surface 40A, which is one side of the photosensitive material 40.

The jetting tank 312B of the applying device 310 is disposed at a position further upstream the conveying path 14 than the jetting tank 312C, and applies the second solution including hydrogen peroxide on the emulsion surface 40A immediately after the second alkaline processing solution has been applied thereon. Accordingly, on the emulsion surface 40A of the photosensitive material 40, the applied second solution including hydrogen peroxide is mixed with the second alkaline processing solution which has been applied thereon.

The jetting tank 312C of the applying device 310 applies the second stabilizing solution, which is a post-processing solution described above, on the emulsion surface 40A a predetermined amount of time after the second solution including hydrogen peroxide has been applied thereon.

Due to this structure, on the emulsion surface 40A of the photosensitive material 40, the second alkaline processing solution is applied, and immediately thereafter, the second solution including hydrogen peroxide is applied thereon to mix therewith. Next, after a predetermined amount of time elapses, the second stabilizing solution is applied.

Each of the jetting tanks 312A, 312B, 312C of the applying devices 310 jets the respective processing solution from the nozzle holes 324 thereof (shown in FIG. 4) which do not touch the emulsion surface 40A of the photosensitive material 40. This can prevent the second solution including hydrogen peroxide and the second stabilizing solution, from deteriorating. The cause of such deterioration is that the chemical substance on the emulsion surface 40A flows in reverse into the nozzle holes 324 and mixes in the second solution including hydrogen peroxide stored in the jetting tank 312B of the applying device 310 or with the second stabilizing solution stored in the jetting tank 312C and then chemical changes and the like are caused.

Therefore, the second solution including hydrogen peroxide and the second stabilizing solution as a post-processing solution, which are stored in the jetting tank 312B and the jetting tank 312C of the applying device 310, respectively, so as not to deteriorate, can be used up without wasting.

On the emulsion surface 40A of the photosensitive material 40, the second alkaline processing solution and the second solution including hydrogen peroxide are separately deposited in a short time so as to be layered on each other by the jetting tanks 312A and 312B of the two applying devices 310 in the above-described manner. The photosensitive material 40 is then conveyed along the heat-control section 354 which is at a position along the conveying path 14 that is downstream with respect to the jetting tanks 312A and 312B of the applying devices 310 on the conveying path 14. During the conveyance, chemical changes are caused and the development-intensification processing is performed.

As shown in FIG. 15, the stabilizing section 25, which serves as the means for post-processing which is a step for ensuring preservation properties of the image formed on the photographic material 40, is disposed at a vicinity of a furthest-downstream position with respect to the heat-control section 354. The stabilizing section 25 effects stabilizing processing by applying the second stabilizing solution as the post-processing solution from the jetting tank 312C of the applying device 310, onto the emulsion surface 40A of the photosensitive material 40 on the conveying path 14.

Rollers 100 are disposed at an adjacent position further downstream than the jetting tank 312C on the conveying path 14. The rollers 100 rotate on the photosensitive material 40 while nipping the photosensitive material 40 therebetween so as to squeeze off the post-processing solution.

Further, a drying section may be included at the portion extending from the rollers 100 to the outlet 16.

In the image forming apparatus of the sixth embodiment, the structure and effects other than those described above are the same as those of the previously described second embodiment. Accordingly, the same members are given the same reference numerals, and detailed descriptions thereof are omitted.

Further, the photosensitive material 40 and each of the processing solutions and post-processing solutions in the image forming apparatus of the present sixth embodiment are equivalent to those described in the second example of the first embodiment.

Next, a description will be provided of operation and method of use of the image forming apparatus relating to the sixth embodiment structured as described above, with reference to FIG. 15.

First, image signals of an original document are input by using the scanner of the like, and are subjected to the image processing, so as to prepare the exposing section 18 for operation.

Subsequently, when a command for forming the image of the original document on the photosensitive material 40 is input to the controlling section (not shown) of the apparatus body 10, the paper feeding section 12 is operated by the command of the controlling section, and the band-shaped photosensitive material 40 is fed onto the conveying path 14. The photosensitive material 40, which has been fed a predetermined length onto the conveying path in this matter, is cut into a predetermined size by the cutter 38, and is then conveyed to the exposing section 18.

At the exposing section 18, the emulsion surface 40A, which is one side of the photosensitive material 40, is exposed in accordance with an image processed-data to form a latent image which corresponds to the image on the original document. The photosensitive material 40 is then conveyed to the development-intensification processing section 20. At the development-intensification processing section 20, the second alkaline processing solution (alkaline activator solution) at a predetermined temperature (approximately of from 35 to 45° C.) is applied onto the emulsion surface 40A of the photosensitive material 40. The second alkaline solution is applied with the jetting tank 312A of the applying device 310 serving as the processing solution applying means.

The conditions for application at this time are as follows: the quantity of the second alkaline processing solution applied is 20 cc/m$^2$, the pitch P between the nozzle holes is $(\sqrt{3})\cdot D/2$ or less =150 $\mu$m, the width of the nozzle (the width from one end to the other of the plurality of nozzle holes of the jetting tank 312, in the direction intersecting the direction the photosensitive material 40 is moved) is 5.5 cm, and the length for application (the length of the second alkaline processing solution applied as the photosensitive material is moved beneath the nozzle) is 12 cm.

Further, immediately after the second alkaline processing solution is applied, the second solution including hydrogen peroxide is layered by the jetting tank 312B, onto the second alkaline processing solution on the emulsion surface 40A of the photosensitive material 40. The conditions for application at this time are as follows: the quantity of the second solution including hydrogen peroxide applied is 20 cc/m$^2$, the pitch P between the nozzle holes is $(\sqrt{3})\cdot D/2$ or less=150 $\mu$m, the width of the nozzle is 5.5 cm, and the length for application is 12 cm.

The photosensitive material 40 is then subjected to the developing processing for 18 seconds, during which the photosensitive material 40 is conveyed on the conveying path 14, which is on the heat panel. The heat panel is means for adjusting heating temperature of the development-intensification processing section 20, and adjusts the temperature to approximately 40° C.

The stabilizing section 25 is disposed towards the furthest downstream portion of the development-intensification processing section 20. At the stabilizing section 25, the second stabilizing solution adjusted to a solution temperature of between 35 to 45° C. is deposited by the jetting tank 312C onto the emulsion surface 40A of the photosensitive material 40 to carry out stabilizing processing. The post-processing solution is then squeezed off by nipping the photosensitive material 40 between the rollers 100. Thereafter, the photosensitive material is conveyed on the conveying path so as to be conveyed from the outlet 16 onto the tray as a finished product on which the image has been formed. As a result, a series of controlling operations for the image forming processing is completed.

The processing in each of the above-described operation processes is performed only for the emulsion surface 40A which is one side of the photosensitive material 40.

Accordingly, compared with the case in which both the emulsion surface 40A of the photosensitive material 40 and the surface opposite to the emulsion surface 40A are wetted in the same manner, such as in a conventional so-called dipping method or the like, the amount of the processing solutions and the post-processing solutions to be applied can be reduced and the deterioration of the processing solutions and the post-processing solutions as a whole can be decreased. Further, compared with the case in which the entirety of the two surfaces of the photosensitive material 40 are dried in the same manner, the time for drying can be shortened and thus the time for processing can be shortened considerably, because the emulsion surface 40A side of the photosensitive material 40 is primarily required to be dried.

Plural series of routes, in which the previously described processing operations such as exposing, developing, drying and the like are performed, may be provided in the image forming apparatus.

In the present sixth embodiment, by carrying out post-processing in which the acidic second stabilizing solution is applied, residual silver on the emulsion surface 40A of the photosensitive material 40 forms a complex compound, thus effecting stabilization. Simultaneously, citric acid in the second stabilizing solution neutralizes the alkaline component which is applied on the emulsion surface 40A by applying the second alkaline processing solution thereon, in a prior step. As a result, the preservation properties of an image formed on the photosensitive material 40 are ensured.

Accordingly, one of the processing steps, i.e., cleaning off the alkaline components of the photosensitive material 40, may be omitted from among all of the processing steps for forming an image with the image forming apparatus. Thus, the structure of the image forming apparatus can be simplified correspondingly to the omission of one of the processing steps, and the image forming apparatus can be manufactured at reduced cost.

Further, the second alkaline processing solution, the second solution including hydrogen peroxide and the second stabilizing solution applied onto the emulsion surface 40A of the photosensitive material by the jetting tanks 312A, 312B, and 312C, respectively, of the applying devices 310 are each of a small amount. Accordingly, the photosensitive material 40 to which processing solutions have been applied dries out while it is conveyed on the conveying path 14, even if a drying section is not provided. Thus, the processing time can be significantly reduced, and the structure of the image forming apparatus can be simplified correspondingly with reducing the steps of the image forming apparatus. The image forming apparatus can thereby be manufactured at less cost.

Further, the processing solution and the post-processing solution can be stably stored so as not to deteriorate with time. Accordingly, the present invention may be favorably applied to a case in which image forming processing is effected intermittently between long rest periods.

In each of the above-described embodiments, image forming processing of each type can be effected suitably and speedily by the processing solution applying means of the image forming apparatus, even if a silver halide photographic photosensitive material has a photographic structuring layer on both surfaces of the support thereof.

In the case of using a silver halide photographic photosensitive material having a photographic structuring layer on both surfaces of the support thereof, images can be formed on both sides of the photosensitive material 40 by using the respective image forming apparatus of the embodiments and effecting the image forming processings twice.

In this way, an image forming apparatus of each embodiment can be used for a single-sided silver halide photographic photosensitive material, as well as for a two-sided silver halide photographic photosensitive material. Accordingly, usage applications of the image forming apparatus are expanded, and the merits of using the image forming apparatus can be increased.

In the above case, an image forming apparatus of the present invention may comprises two (post-) processing solution applying means, separately from each other or in an integral structure connected together so as to effect image forming processing on both sides simultaneously In this case, in which the image forming processings for the obverse and reverse surface are effected at the same time, each of the processings for the photosensitive material 40 can be effected suitably and speedily, using the processing solutions and the post-processing solutions efficiently, even when so-called dipping means is used as the processing solution applying means. This is because excess processing solution or post-processing solution is not applied to a reverse surface of the photosensitive material at which a photographic structuring layer is not provided, as in the case of dipping a material provided with a photographic structuring layer on only one surface of the photosensitive material 40.

Accordingly, in the case in which image forming processings are effected at the same time for the obverse and reverse surfaces, a structure is used in which so-called dipping means is included among the (post-) processing solution applying means.

Further, in the present specification, "post-processing" indicates a step for ensuring preservation properties of a formed image. The term "post-processing" includes, for example: "rinsing" in which residue on photosensitive material is removed after fixing processing (rinsing off silver components on the photosensitive material using a hypo or the like); and processing for applying a second stabilizing solution for ensuring preservation properties of an image formed on a photosensitive material (so-called stop processing), in which an acid is used to neutralize alkaline components applied in a prior step, while effecting stabilization in which residual silver on the photosensitive material forms a complex compound.

What is claimed is:

1. An image forming apparatus comprising:

processing solution applying means for applying alkaline processing solution including hydrogen peroxide, which alkaline processing solution is substantially devoid of developing agents, to substantially only a photographic structuring layer side of an exposed silver halide photographic photosensitive material, the silver halide photographic photosensitive material having a support and at least one photographic structuring layer formed on the support, which photographic structuring layer comprises a dye-forming coupler and a reducing agent;

heat controlling means positioned after the processing solution means, for heating the photosensitive material so as to cause a chemical reaction; and post-processing means for processing the photographic structuring layer with post-processing solution, after the silver halide photographic photo-sensitive material has been processed with the alkaline processing solution including hydrogen peroxide, wherein the post-processing means further includes a cleaning means having an applicator for applying a cleaning solution to only the photographic structuring layer side of the photosensitive material, and a container positioned under the cleaning means for catching the cleaning solution.

2. The image forming apparatus of claim 1, wherein the post-processing solution acts as a stabilizing means and is applied only to the photographic structuring layer side of the photosensitive material; and squeezing means placed between the cleaning means and the stabilizing means for squeezing off the cleaning solution.

3. The image forming apparatus of claim 2, wherein the post-processing solution comprises an agent which forms a complex compound with silver.

4. The image forming apparatus of claim 2, wherein the post-processing solution comprises an acidic solution.

5. The image forming apparatus of claim 2, wherein the post-processing means comprises a plurality of nozzle holes.

6. The image forming apparatus of claim 1, wherein photosensitive material which passes through the cleaning means is conveyed at an incline such that the cleaning solution is pulled by gravity in an opposite direction of the conveyed photosensitive material and is collected in a container.

7. The image forming apparatus of claim 1, wherein the silver halide photographic photosensitive material has an additional photo structuring layer side, and the apparatus further comprises a second processing solution applying means.

8. The image forming apparatus of claim 7, further comprising two post-processing means for processing the photographic structuring layers with post-processing solution, after the silver halide photographic photosensitive material has been processed with the alkaline processing solution including hydrogen peroxide.

9. The image forming apparatus of claim 1, wherein the processing solution applying means comprises a plurality of nozzle holes.

10. The image forming apparatus of claim 1, wherein the processing solution applying means includes a felt.

11. The image forming apparatus of claim 1, wherein the processing solution applying means includes a member having a slit defined therein for extruding solution for application thereof.

12. The image forming apparatus of claim 1, wherein the processing solution applying means includes a porous roller.

13. An image forming apparatus comprising:

processing solution applying means for applying alkaline processing solution, which is substantially devoid of developing agents, to substantially only a photographic structuring layer side of an exposed silver halide photographic photosensitive material, the silver halide photographic photosensitive material having a support and at least one photographic structuring layer formed on the support, which photographic structuring layer comprises a dye-forming coupler and a reducing agent;

heat controlling means positioned after the processing solution means, for heating the photosensitive material so as to cause a chemical reaction to complete a development intensification process;

post-processing means for processing the photographic structuring layer with post-processing solution, after the silver halide photographic photosensitive material has been processed with the alkaline processing solution, and wherein the post-processing means further includes a cleaning means having an applicator for applying a cleaning solution to only the photographic structuring layer side of the photosensitive material, and a container positioned under the cleaning means for catching the cleaning solution.

14. The image forming apparatus of claim 13, further comprising processing solution applying means for applying solution including hydrogen peroxide to substantially only the photographic structuring layer side of the silver halide photographic photosensitive material, after the silver halide photographic photosensitive material has been processed with the alkaline processing solution.

15. The image forming apparatus of claim 14, wherein the post-processing solution acts as a stabilizing means for processing the photographic structuring layer side after the silver halide photographic photosensitive material has been processed with the alkaline processing solution and the solution including hydrogen peroxide; and squeezing means placed between the cleaning means and the stabilizing means for squeezing off the cleaning solution.

16. The image forming apparatus of claim 15, wherein the post-processing solution comprises an agent which forms a complex compound with silver.

17. The image forming apparatus of claim 15, wherein the post-processing solution comprises an acidic solution.

18. The image forming apparatus of claim 14, wherein the cleaning means is for cleaning substantially only the photographic structuring layer side of the silver halide photographic photosensitive material, after the silver halide photographic photosensitive material has been processed with the alkaline processing solution and the solution including hydrogen peroxide.

19. The image forming apparatus of claim 13, wherein the silver halide photographic photosensitive material has an additional photo structuring layer side, and the apparatus further comprises a second processing solution applying means.

20. The image forming apparatus of claim 13, wherein the processing solution applying means comprises a plurality of nozzle holes.

21. The image forming apparatus of claim 13, wherein the processing solution applying means includes a felt.

22. The image forming apparatus of claim 13, wherein the processing solution applying means includes a member having a slit defined therein for extruding solution for application thereof.

23. The image forming apparatus of claim 13, wherein the processing solution applying means includes a porous roller.

24. The image forming apparatus of claim 13, wherein photosensitive material which passes through the cleaning means is conveyed at an incline such that the cleaning solution is pulled by gravity in an opposite direction of the conveyed photosensitive material and is collected in a container.

25. An image forming apparatus comprising:

processing solution applying means for applying solution including hydrogen peroxide to substantially only a photographic structuring layer side of an exposed silver halide photographic photosensitive material, the silver halide photographic photosensitive material having a support and at least one photographic structuring layer formed on the support, which photographic structuring layer comprises a dye-forming coupler and a reducing agent;

heat controlling means positioned after the processing solution means, for heating the photosensitive material so as to cause a chemical reaction; and post-processing means for processing the photographic structuring layer with post-processing solution, after the silver halide photographic photosensitive material has been processed with the solution including hydrogen peroxide, wherein the post-processing means further includes a cleaning means having an applicator for applying a cleaning solution to only the photographic structuring layer side of the photosensitive material, and a container positioned under the cleaning means for catching the cleaning solution.

26. The image forming apparatus of claim 25, wherein the silver halide photographic photosensitive material has an additional photo structuring layer side, and the apparatus further comprises a second processing solution applying means.

27. The image forming apparatus of claim 25, wherein the processing solution applying means comprises a plurality of nozzle holes.

28. The image forming apparatus of claim 25, wherein the post-processing solution acts as a stabilizing means for processing the photographic structuring layer side after the silver halide photographic photosensitive material has been processed with the solution including hydrogen peroxide; and squeezing means placed between the cleaning means and the stabilizing means for squeezing off the cleaning solution.

29. The image forming apparatus of claim 25, wherein photosensitive material which passes through the cleaning means is conveyed at an incline such that the cleaning solution is pulled by gravity in an opposite direction of the conveyed photosensitive material and is collected in a container.

* * * * *